US009249982B2

(12) United States Patent
Brown et al.

(10) Patent No.: US 9,249,982 B2
(45) Date of Patent: Feb. 2, 2016

(54) CEILING VENT DIFFUSER

(75) Inventors: Chad A. Brown, Toronto (CA); Robert G. Dickie, King City (CA); Petri J. Nurmela, Thunder Bay (CA); Jonathan D. Liberty, Newmarket (CA)

(73) Assignee: Airvisor Inc., Toronto, Ontario (CA)

( * ) Notice: Subject to any disclaimer, the term of this patent is extended or adjusted under 35 U.S.C. 154(b) by 1239 days.

(21) Appl. No.: 13/181,237

(22) Filed: Jul. 12, 2011

(65) Prior Publication Data

US 2011/0269391 A1 Nov. 3, 2011

Related U.S. Application Data

(63) Continuation-in-part of application No. 12/062,239, filed on Apr. 3, 2008, now Pat. No. 8,002,013.

(51) Int. Cl.

| | |
|---|---|
| ***F24F 13/06*** | (2006.01) |
| ***F24F 13/08*** | (2006.01) |
| ***F24F 13/075*** | (2006.01) |
| ***F24F 13/14*** | (2006.01) |

(52) U.S. Cl.
CPC ..... *F24F 13/075* (2013.01); *F24F 13/14* (2013.01)

(58) Field of Classification Search
CPC ..... F24F 13/14; F24F 13/075
USPC ..... 454/358, 307
See application file for complete search history.

(56) References Cited

U.S. PATENT DOCUMENTS

| | | | | | |
|---|---|---|---|---|---|
| 574,024 | A | * | 12/1896 | Eby | 454/307 |
| 1,438,016 | A | * | 12/1922 | Bourke | 74/503 |
| 1,450,819 | A | | 4/1923 | Sammes | |
| 1,518,023 | A | * | 12/1924 | Ullom | 160/56 |
| 1,558,518 | A | * | 10/1925 | Truax | 49/53 |
| 1,668,712 | A | * | 5/1928 | Everhard | 160/57 |
| 1,679,773 | A | * | 8/1928 | Knowles | 454/289 |
| 1,939,294 | A | | 12/1933 | Hartwell | |
| 1,975,686 | A | | 10/1934 | Froelich | |
| 2,127,072 | A | | 8/1938 | Tinnerman | |
| 2,177,994 | A | * | 10/1939 | Person | 454/149 |
| 2,216,873 | A | * | 10/1940 | Browne | 454/183 |
| 2,471,980 | A | * | 5/1949 | Collins et al. | 454/333 |
| 2,558,421 | A | * | 6/1951 | Daninhirsch | 454/302 |
| 2,580,663 | A | * | 1/1952 | Delf et al. | 454/210 |
| RE23,560 | E | | 9/1952 | Herbster | |
| 2,630,055 | A | * | 3/1953 | Priesmeyer | 454/311 |

(Continued)

FOREIGN PATENT DOCUMENTS

| | | | | |
|---|---|---|---|---|
| GB | 1085389 | | 9/1967 | |
| JP | 2003265873 | A * | 9/2003 | B26B 1/08 |

*Primary Examiner* — Alissa Tompkins
*Assistant Examiner* — Phillip E Decker
(74) *Attorney, Agent, or Firm* — Sand & Sebolt

(57) ABSTRACT

A device for altering the airflow pattern from a ceiling vent diffuser by obstructing openings in a region of the diffuser. The device comprises a flexible member that is secured to a diffuser vane by a hook member and two tabs. The hook member has two or more engagement regions which enable it to engage vanes on different manufacturer's diffusers. The first end of the hook member is either pivotally secured to the flexible member or is engaged in an adjustment mechanism thereon. The adjustment mechanism allows the second end of the hook to be situated in different positions relative to an interior edge of the flexible member so as to accommodate different diffusers. An extension detachably engages the flexible member to increase the size thereof to accommodate larger diffusers.

21 Claims, 20 Drawing Sheets

(56) References Cited

U.S. PATENT DOCUMENTS

| | | | | | |
|---|---|---|---|---|---|
| 2,761,371 | A | | 9/1956 | Parrish | |
| 2,784,659 | A | | 3/1957 | De Roo et al. | |
| 2,983,048 | A | * | 5/1961 | Keller | 33/27.03 |
| 3,003,244 | A | * | 10/1961 | Fogliano | 33/341 |
| 3,046,866 | A | | 7/1962 | Straub | |
| 3,768,235 | A | | 10/1973 | Meyer et al. | |
| 4,010,518 | A | | 3/1977 | Rejeski et al. | |
| 4,089,112 | A | * | 5/1978 | Richards | 30/162 |
| 4,602,556 | A | | 7/1986 | Gladden | |
| 4,693,174 | A | * | 9/1987 | Anderson | 454/292 |
| 4,760,773 | A | * | 8/1988 | Pezzulli | 454/358 |
| 4,815,934 | A | | 3/1989 | Rademaker | |
| 5,213,543 | A | | 5/1993 | Clarino | |
| 5,232,403 | A | * | 8/1993 | Marotta | 454/289 |
| 5,297,326 | A | | 3/1994 | Kline | |
| D355,354 | S | * | 2/1995 | Sterling | D8/382 |
| 5,410,782 | A | | 5/1995 | Holyoake | |
| 5,564,975 | A | * | 10/1996 | Northcutt | 454/298 |
| 6,010,402 | A | | 1/2000 | Schmidt | |
| 6,261,174 | B1 | * | 7/2001 | Kuehn | 454/290 |
| 6,554,880 | B1 | * | 4/2003 | Northcutt | 454/292 |
| 6,840,852 | B2 | | 1/2005 | Gehring et al. | |
| 7,074,124 | B2 | * | 7/2006 | Williams | 454/358 |
| 7,635,298 | B2 | | 12/2009 | Henneberry | |
| 2006/0040607 | A1 | | 2/2006 | Perez et al. | |
| 2007/0181271 | A1 | | 8/2007 | Earnest | |
| 2011/0081853 | A1 | * | 4/2011 | Roebuck | 454/307 |
| 2013/0128450 | A1 | * | 5/2013 | Redshaw et al. | 454/308 |

* cited by examiner

CEILING VENT DIFFUSER

CROSS-REFERENCE TO RELATED APPLICATIONS

This application is a Continuation-in-Part of U.S. patent application Ser. No. 12/062,239 filed Apr. 3, 2008, the entire specification of which is incorporated herein by reference.

BACKGROUND OF THE INVENTION

1. Technical Field

This invention generally relates to air circulation systems for buildings. More particularly, the invention relates to ceiling vents. Specifically, the invention relates to a cover that is detachably connectable to a ceiling vent diffuser to block airflow from a region of the diffuser.

2. Background Information

Most industrial and commercial buildings have 24"×24" square ceiling vent diffusers that are mounted on drywall or T-bar ceilings. Occasionally, buildings may be provided with circular vent diffusers, but these are less common than the square version. The vent diffusers are standardized to fit in the 24" T-bar ceiling spacing and can be made with three or four vents through which heated or cooled air is introduced into the room. The diffusers alter the direction of the air flowing out of the vent so that the air does not flow straight down into the room and at right angles to the ceiling. Instead, the diffuser causes the air to flow outwardly equally in all directions and through 360 degrees from the vent. Initially, the air is blown generally along a portion of a ceiling and eventually drops into the room at a distance from the vent itself.

When heating and air-conditioning contractors are designing and installing heating and cooling systems, their main focus is the overall balance of heating and cooling circulation in any particular area of the building. The contractor will add butterfly type air flow controllers in the pipe that connects to the top of the diffuser. The flow valves for the system are adjusted in an attempt to give the building as constant a temperature as possible. The contractors typically install, test and adjust the heating and cooling system before any furniture or employees are housed in the building. When employees are finally settled into the premises, they may discover that they have hot or cold air blowing directly onto them from vents located in close proximity to their desks. This situation may lead to much discomfort on the part of the employees who may try to minimize their discomfort by shutting the vent or taping cardboard or some other material over the same. Another possible solution is for a company that maintains the system to remove the diffuser and adjust the airflow butterfly valve to reduce the overall flow of air through the diffuser. This adjustment of the butterfly valve does not affect the direction of the flow but, instead, affects the volume of air flowing through the vent. This airflow reduction may make life more pleasant for the employee sitting close to the vent but it can also have negative implications for the overall temperature of the building.

There is therefore a need in the art for a device and method that allows for quick and easy adjustment of the airflow through a vent diffuser.

SUMMARY OF THE INVENTION

The device of the present invention comprises a cover that is selectively engageable with a vent diffuser to allow for directional adjustment of the airflow through the vent without affecting the volume of air flowing outwardly from the same.

The device comprises a flexible member that is secured to a diffuser vane by a spring-biased hook member and one or more tabs. A release button on the outer surface of the device is depressed to pivot the hook member out of engagement with the vane.

The device is complementary shaped to a region of the diffuser. If a typical square diffuser is viewed from the position of the mouth of the vent pipe to which the diffuser is attached, then the diffuser may be considered to have four directional quadrants out of which air flows. Those quadrants are effectively directed toward the north, the south, the east and the west. Under normal operating conditions, air radiates outwardly and downwardly from the vent and through the diffuser in all four quadrants. The device of the present invention provides a mechanism for blocking airflow in a selected one of the quadrants. When installed, the device blocks the openings in that region and substantially prevents air from flowing out of the openings. The device can be quickly and easily installed and removed and thereby allows for rapid blocking of the airflow in any one direction from the diffuser. The airflow out of the remaining three quadrants is increased proportionately, but the overall volume of air flowing out of the vent is not reduced. Consequently, the airflow at a particular workstation, for example, may be effectively blocked, but the overall temperature of the building is relatively unaffected.

One or more devices may be installed in selected regions to block airflow from those selected regions. A plurality of devices may be utilized to completely prevent airflow from the diffuser.

In alternative embodiments of the invention, the hook member is provided with two or more engagement regions which enable it to engage vanes on different manufacturer's diffusers. The first end of the hook member is either pivotally secured to the flexible member or is engaged in an adjustment mechanism thereon. The adjustment mechanism allows the first end of the hook member to be reciprocally moved along a channel in the adjustment mechanism which then causes the second end of the hook to be situated in different positions relative to an interior edge of the flexible member. This enables the installer to install the flexible member on differently configured diffusers. An extension member is detachably engaged with the flexible member to increase the overall size thereof to accommodate larger diffusers. The extension member is easily removed to reduce the size of the diffuser. The hook member may further include a second end that is curved toward the inner surface of the flexible member and is biased toward the same.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
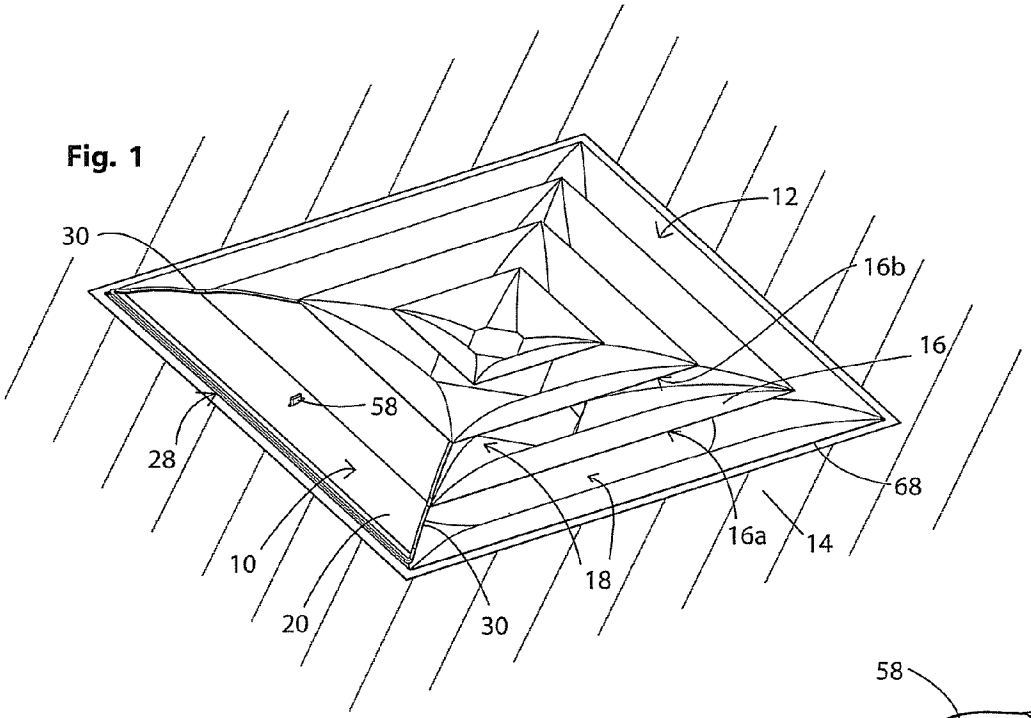
FIG. 1 is a perspective front view of a four-vane diffuser installed on a ceiling, with the diffuser having a cover in accordance with the present invention installed thereon.

Referring to FIGS. 1-14 there is shown a vent diffuser cover in accordance with the present invention and generally indicated at 10. Cover 10 is designed to be engaged with a vent diffuser 12 to change the airflow pattern therefrom. The vent diffuser 12 is positioned in front of a vent (not shown) in the ceiling 14 and typically is either square or circular in shape. Diffuser 12 is shown as having four vanes 16 and openings 18 therebetween through which air can flow.

In accordance with a specific feature of the present invention, cover 10 comprises a flexible member 20 that preferably is manufactured from a plastic material. Flexible member 20 may be transparent so that it is not easily noticed on vent diffuser 12 or may be opaque and colored so that it blends into vent diffuser 12 or colored so that it is easily seen.

Flexible member 20 has an inner surface 22, an outer surface 24, interior edge 26, exterior edge 28 and side edges 30. Interior edge 26 is shorter in length than is exterior edge 28. Consequently, flexible member 20 tapers from exterior edge 28 to interior edge 26 and has the shape of a truncated triangle.

Figure 6:
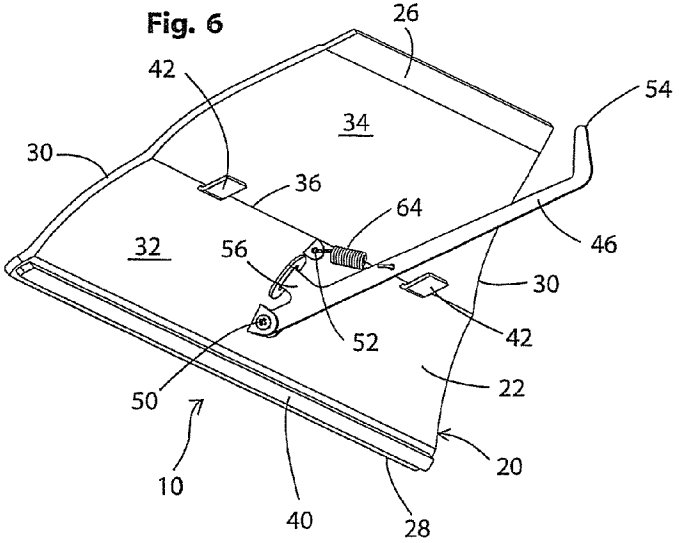
FIG. 6 is a perspective rear view of the vent cover showing the locking mechanism.

As shown in FIG. 6, flexible member 20 is generally planar but is molded to have a first region 32 and a second region 34 that meet along a shallow ridge 36. Each of the first and second regions 32, 34 has a shallow arcuate profile when viewed from the side. This configuration of first and second regions 32, 34 gives flexible member 20 a spring memory. Interior edge 26 is thinned slightly relative to the rest of flexible member 20, thereby creating a lip 38 that runs along the entire length of interior edge 26. Lip 38 forms a part of outer surface 24 of flexible member 20. A seal, comprising an adhesive foam strip 40, is secured to inner surface 22 of flexible member 20 and along exterior edge 28 thereof.

One or more tabs 42 are provided on inner surface 22 of cover 10. Tabs 42 extend from inner surface 22 and are spaced apart from each other. Preferably tabs 42 extend outwardly from inner surface 22 and proximate ridge 36. At least a portion of each tab 42 is spaced a distance from inner surface 22 and is substantially parallel therewith. Consequently, a gap 44 is formed between each tab 42 and inner surface 22. Tabs 42 extend toward interior edge 26 of cover 10 and are provided to engage an outer edge of one of vanes 16 on vent diffuser 12, as will be hereinafter described.

Figure 9:
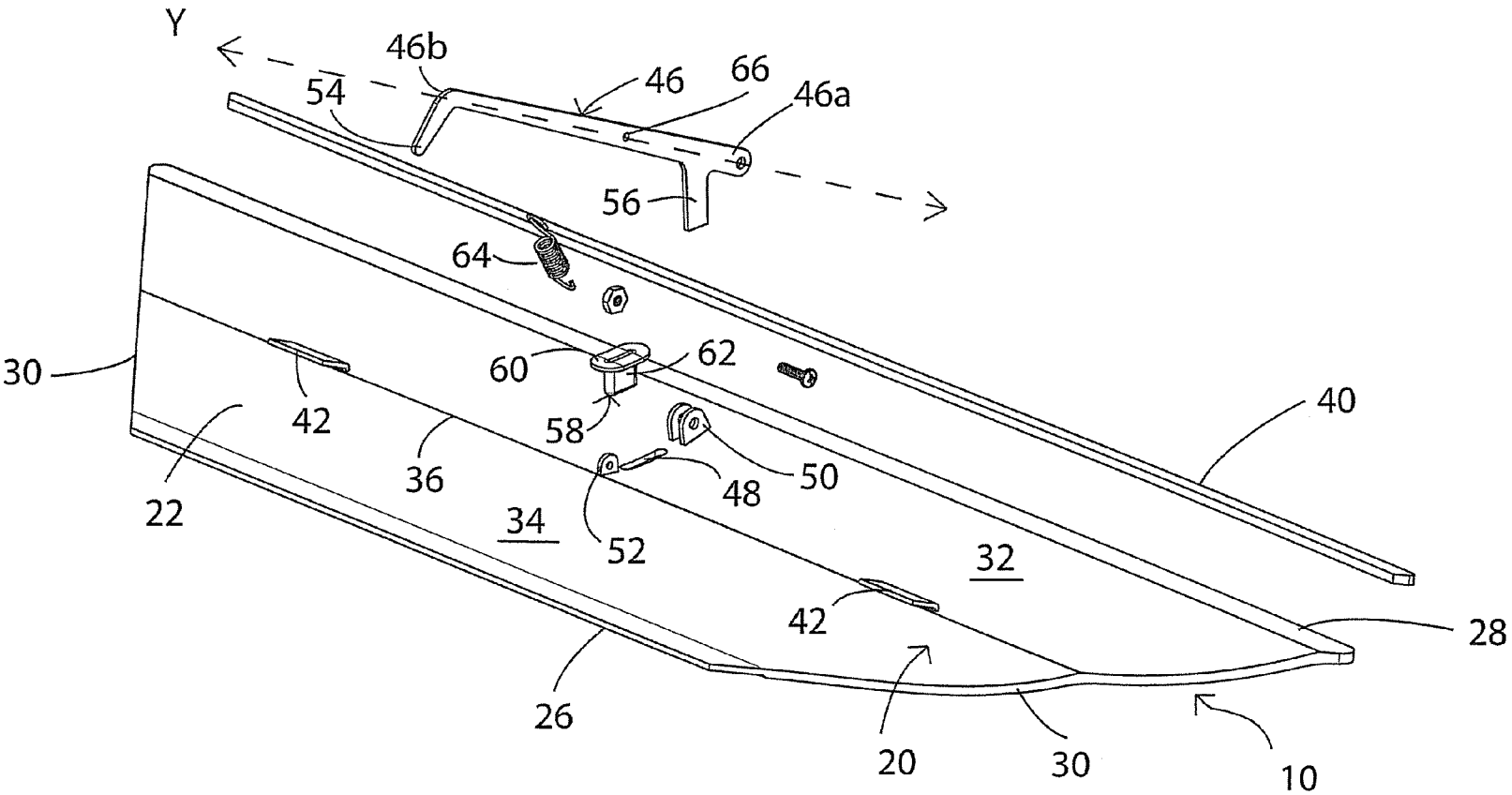
FIG. 9 is an exploded rear view of the vent cover.

Cover 10 is also provided with a locking mechanism for securing it to vent diffuser 12. The locking mechanism comprises an articulated hook member 46 that is engaged with flexible member 20. An aperture 48 is defined in first region 32 of flexible member 20. At least one first mounting bracket 50 extends outwardly from inner surface 22 of flexible member 20 adjacent a first end of aperture 48. At least one second mounting bracket 52 extends outwardly from inner surface 22 of flexible member 20 adjacent a second end of aperture 48. Hook member 46 is a generally L-shaped member having a first end 46*a* (FIG. 9) that is pivotally secured to first mounting bracket 50 and a second end 46*b* remote from said first mounting bracket 50. Second end 46*b* includes a leg 54 that extends inwardly toward inner surface 22 of flexible member 20 when hook member 46 is secured to first mounting bracket 50. Leg 54 extends outwardly from second end 46*b* at an angle of between 80 degrees and 120 degrees to the longitudinal axis "Y" thereof. Hook member 46 is also provided with an arm 56 that extends toward inner surface 22 of flexible member 20. Hook member 46 is spaced a distance inwardly from first end 46*a*. Arm 56 extends outwardly from hook member 46 at an angle of between 70 degrees and 120 degrees to the longitudinal axis Y. As shown in FIG. 9, leg 54 and arm 56 extend outwardly from hook member 46 in opposite directions to each other. An end of arm 56 projects through aperture 48 in flexible member 20 and extends for a short distance beyond outer surface 24 thereof. A rubber cap 58 is provided for the end of arm 56. As shown in FIG. 9, cap 58 preferably includes a lip 60 that abuts inner surface 22 of flexible member 20 and a cup region 62 that retains the end of arm 56 therein. Cup region 62 projects outwardly through aperture 48. Cup region 62 and the end of arm 56 retained therein form a release button that is engageable to manipulate the position of hook member 46. A spring 64 is secured at one end to second mounting bracket 52 and at another end is received through hole 66 (FIG. 9) in hook member 46. Spring 64 is provided to keep leg 54 of hook member 46 biased toward inner surface 22 of flexible member 20.

Figure 2:
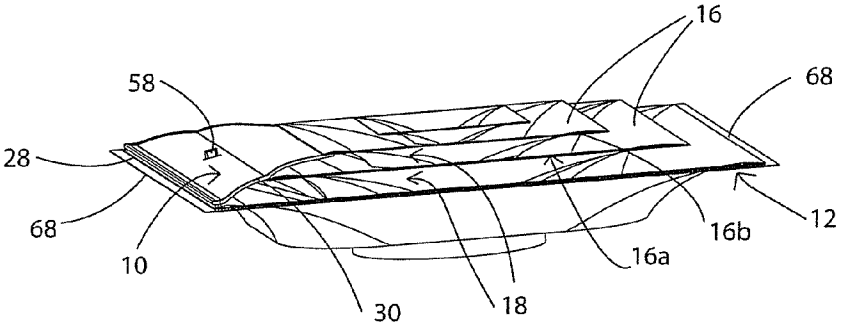
FIG. 2 a perspective front view of the four-vane diffuser taken from a slightly different angle with the ceiling removed for clarity, and showing the openings between the vanes of the vent diffuser.
Figure 4:
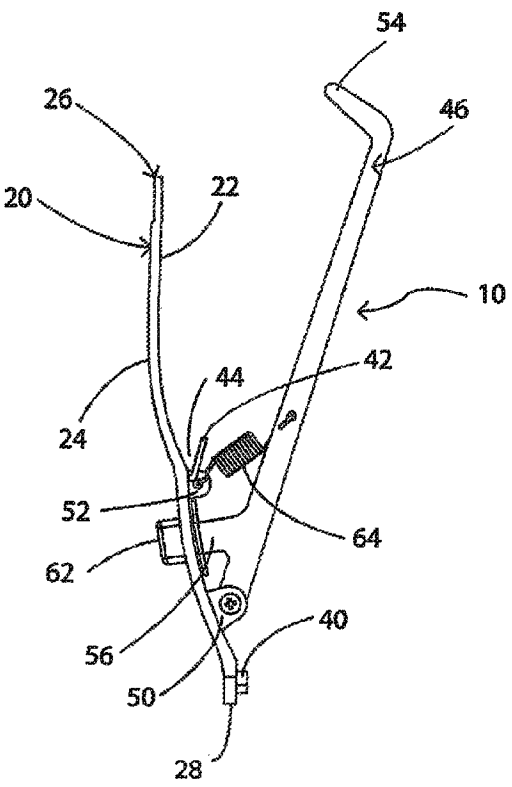
FIG. 4 is a side view of the vent cover of FIG. 3.
Figure 3:
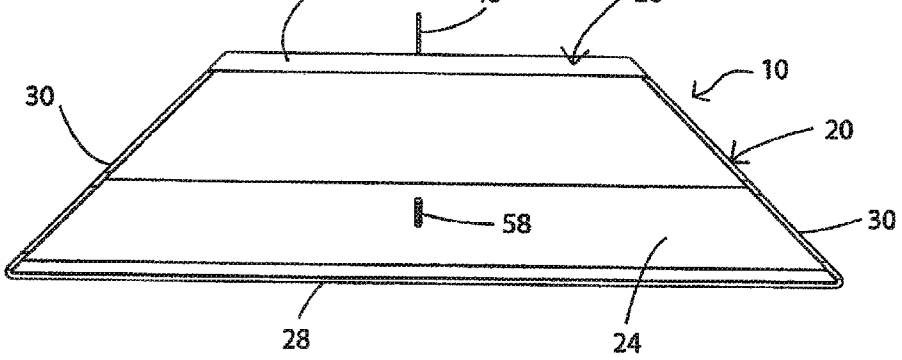
FIG. 3 is a front view of the vent cover in accordance with the present invention.
Figure 5:
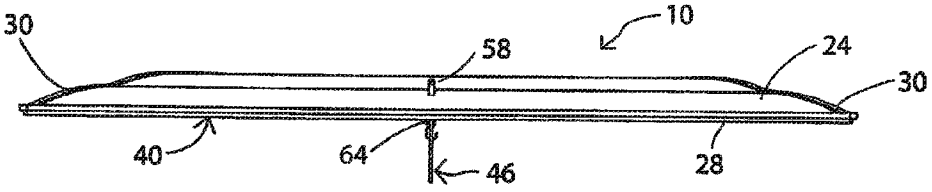
FIG. 5 is an end view of the vent cover.
Figure 8:
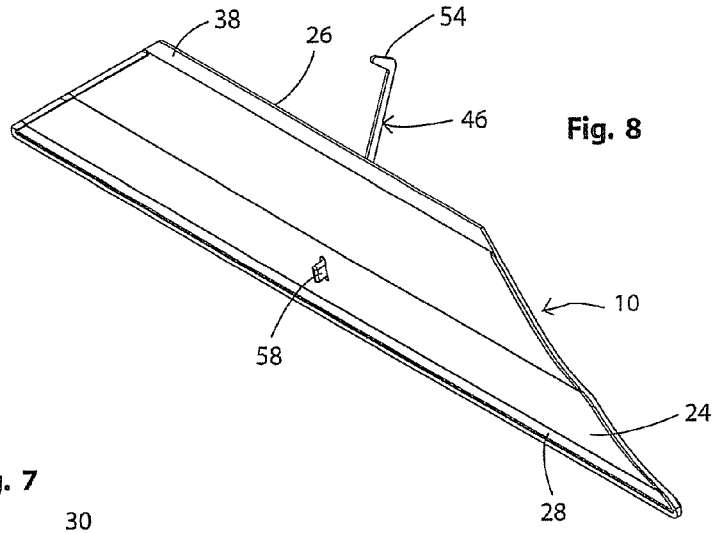
FIG. 8 is a second perspective front view of the vent cover showing the leg and hook member of the locking mechanism extending rearwardly from the cover.
Figure 7:
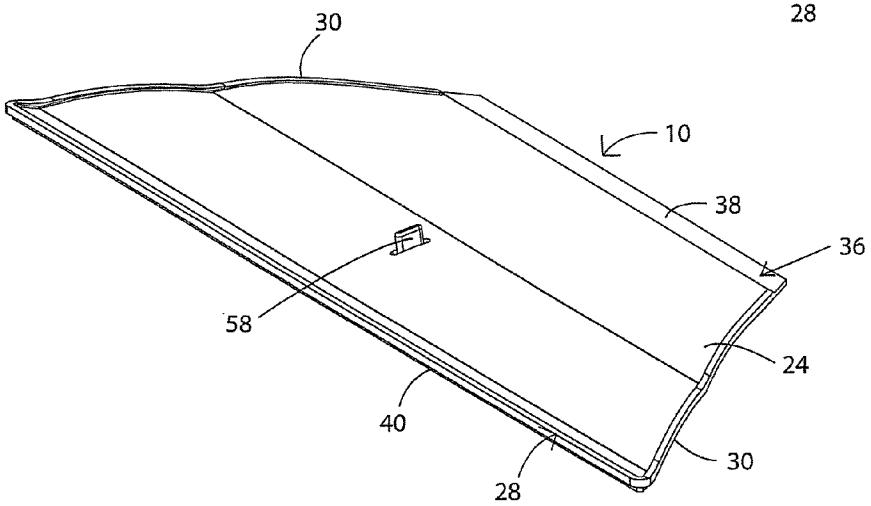
FIG. 7 is a perspective front view of the vent cover showing the release button extending from the outer surface of the cover.
Figure 12:
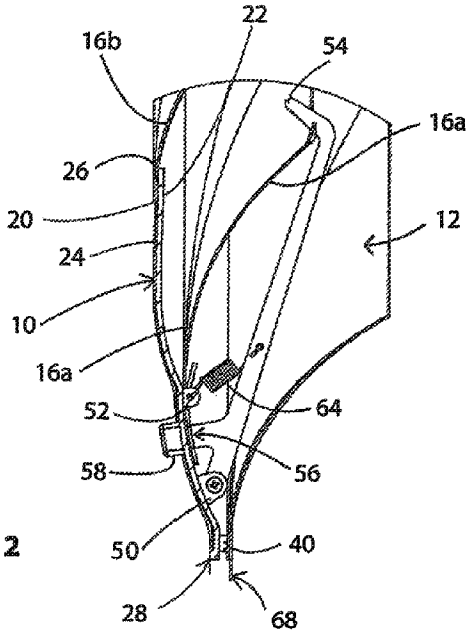
FIG. 12 is an enlargement of the highlighted region of FIG. 11 and showing a portion of the vent cover in cross-section.
Figure 11:
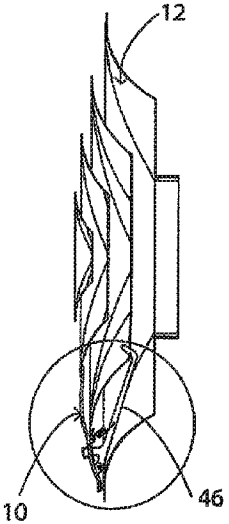
FIG. 11 is a side view of the diffuser and vent cover taken through line 11-11 of FIG. 10.
Figure 10:
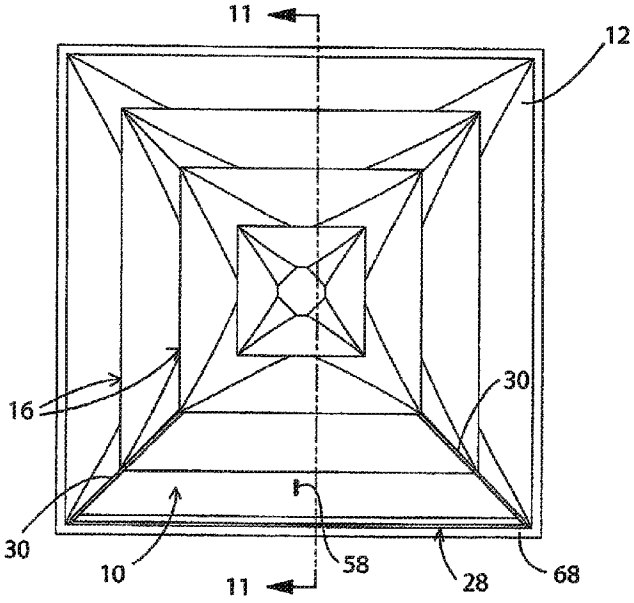
FIG. 10 is a front view of the diffuser with the vent cover installed thereon.

Cover 10 is installed on vent diffuser 12 quickly and easily. In order to install cover, flexible member 20 is slid onto vent diffuser 12 from one side with cover 10 being held at an upward angle so that hook member 46 and tabs 42 slide between first and second vanes 16*a*, 16*b* (FIGS. 1, 2 and 12). As shown in FIG. 12, tabs 42 engage the outermost edge of first vane 16*a*. More specifically, tabs 42 slide under the bottom surface of the outermost edge of first vane 16*a* thereby causing the outermost edge of first vane 16*a* to be captured between tabs 42 and inner surface 22. Leg 54 of hook member 46 engages the innermost edge of the first vane 16 and becomes engaged thereunder. Lip 38 of interior edge 26 slides over the bottom surface of the outermost edge of second vane 16*b*. Because of the shape of flexible member 20 with the slight arcuate bowing of first and second regions 32, 34, the spring memory in the plastic of member 20 keeps lip 38 forced against the second vane 16*b*. Foam strip 40 is seated on the outermost surface of rim 68 of vent diffuser 12. Strip 40 acts as a seal to substantially prevent air from flowing between cover 10 and rim 68. Strip 40 also acts as a dampener and substantially prevents cover 10 from vibrating and rattling against vent diffuser 12 when air flowing through diffuser 12 buffets cover 10. Cover 10 is therefore seated over the exterior surface of diffuser in such a manner that it substantially blocks off openings 18 between vanes 16 in the region of vent diffuser 12 over which it is applied. The person installing cover 10 will be able to confirm that flexible member 20 is secured onto diffuser 12 because the release button formed by arm 56 and cap 58 extends outwardly from outer surface 24 to a greater degree than when cover 10 is detached from diffuser 12.

Figure 14:
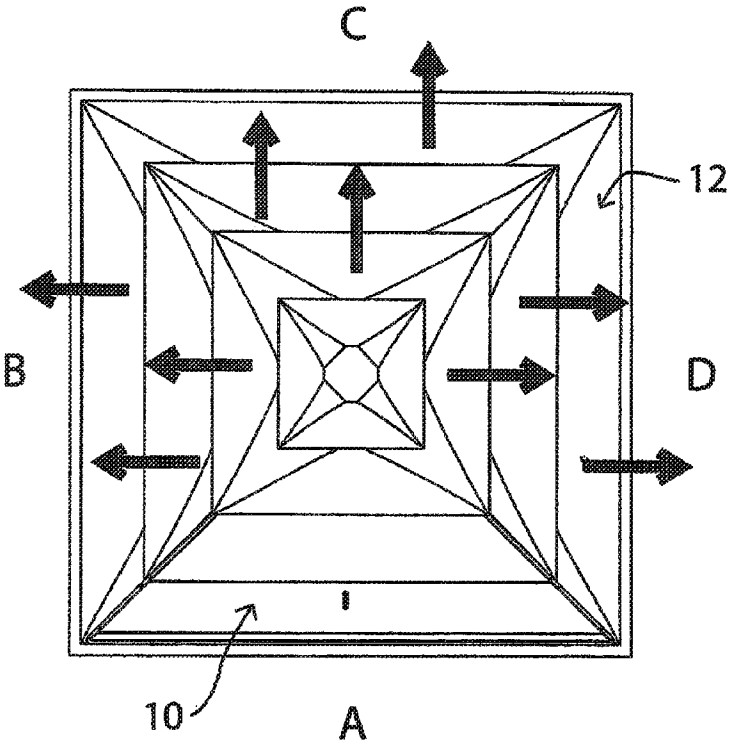
FIG. 14 is a front view of the vent diffuser with a cover installed thereon and showing the airflow pattern from the diffuser.
Figure 13:
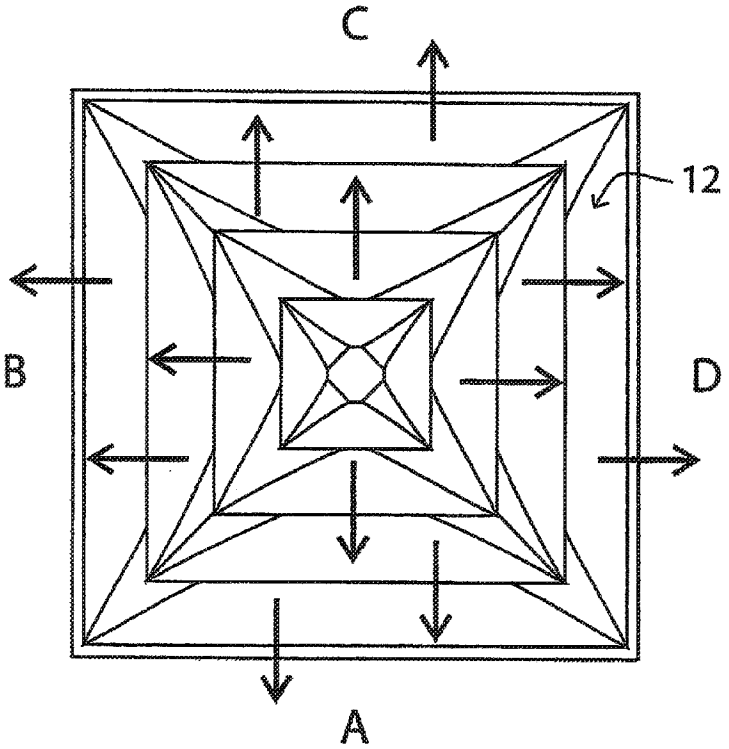
Fig. 13 PRIOR ART
FIG. 13 is a front view of the vent diffuser without a cover installed thereon and showing the airflow pattern from the diffuser.
Figure 15:
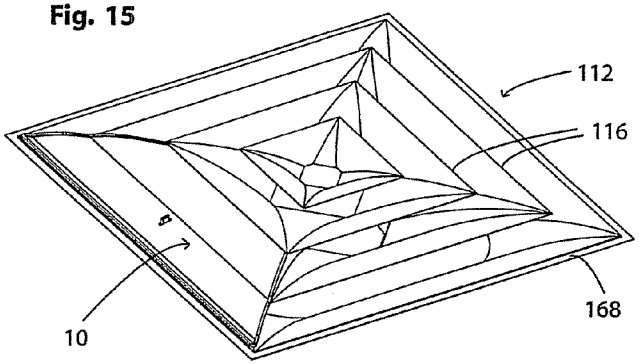
FIG. 15 is a perspective front view of a three-vane diffuser with the vent cover installed thereon.
Figure 16:
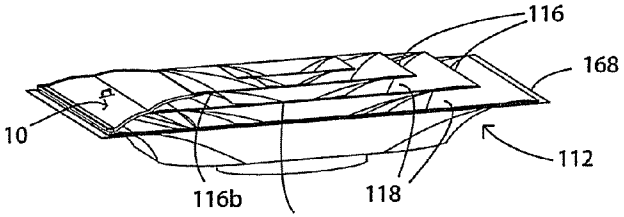
FIG. 16 is a perspective front view of the three-vane diffuser taken from a slightly different angle and showing the vent cover installed thereon.
Figure 18:
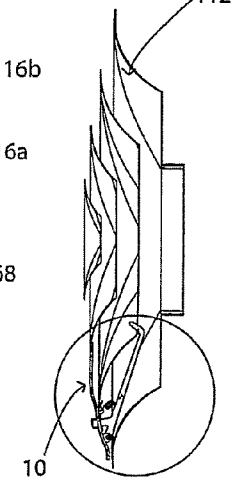
FIG. 18 is a side view of the diffuser and vent cover taken through line 18-18 of FIG. 17.
Figure 19:
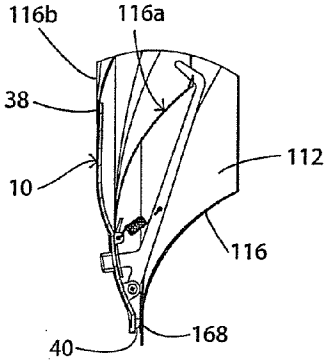
FIG. 19 is an enlargement of the highlighted region of FIG. 18.
Figure 17:
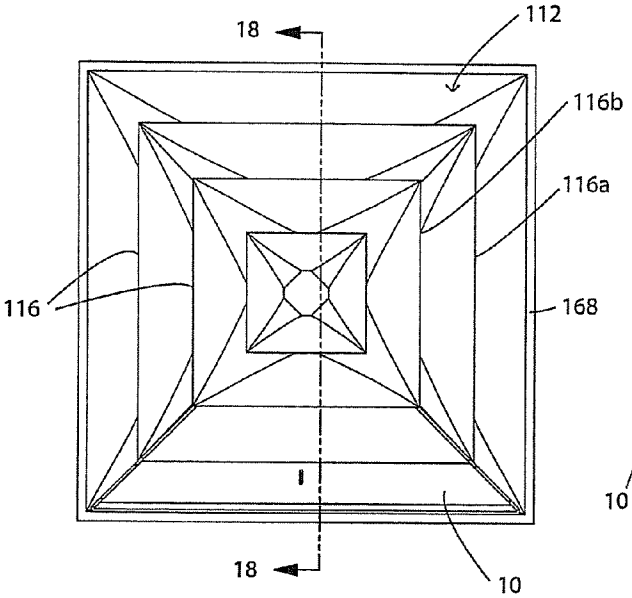
FIG. 17 is a front view of the three-vane diffuser with the vent cover installed thereon.

Cover 10 is designed to affect airflow from diffuser 12. FIG. 13 shows diffuser 12 before a cover 10 is installed thereon. Diffuser 12 is shown divided generally into four quadrants that are labeled A, B, C and D. The arrows illustrate air flowing out of vent diffuser 12 in all four quadrants. FIG. 14 shows vent diffuser 12 after cover 10 has been installed in one quadrant thereof. In this figure, quadrant A has been closed off by cover 10. It can be seen that the airflow from vent diffuser 12 has been changed in that air no longer flows out of quadrant A, but continues to flow out of quadrants B, C, and D. Furthermore, while quadrant A is blocked off, the rate of air flowing out of the vent diffuser 12 does not change but the volume and rate of airflow from the remaining quadrants B, C and D is increased relative to the condition shown in FIG. 13. This increase in the rate of airflow is signified by the larger arrows in FIG. 14. It will be understood that more than one cover 10 may be applied to vent diffuser 12 to change the airflow therefrom. If four separate covers are installed on vent diffuser 12, airflow from vent diffuser 12 will be substantially completely cut off.

When it is desired to remove cover 10, the cap 58 is pushed inwardly toward outer surface 24 of flexible member 20. This inward movement causes hook member 46 to pivot about the connection point of hook member 46 with second mounting bracket 52. Leg 54 is thereby moved outwardly away from the innermost edge of first vane 16*a* and becomes disengaged therefrom. Cover 10 may then be slid off vent diffuser 12.

FIGS. 15-19 show cover 10 installed on a vent diffuser 112 that has three vanes 116 instead of four. Vanes 116 have openings 118 between them through which air can flow. Cover 10 is exactly the same cover that is applied to vent diffuser 12. Lip 38 slides over the exterior surface of vane 116*b*. Tabs 42 slide under the bottom surface of the outermost edge of vane 116*a* while leg 54 engages the bottom surface of the innermost edge of vane 116*a*. Strip 40 rests on rim 168 of diffuser 112. Cover 10 is applied to diffuser 112 in the same manner as to diffuser 12. Cover 10 is also removed therefrom in like manner.

Cover 10 is of a truncated triangular shape so as to be complementary to the shape of a quandrant of a square diffuser 12. It will be understood that the cover can be manufactured to be complementary to a region of a round diffuser (not shown). This cover may be designed to block one quarter of a round vent diffuser or one third of a round vent diffuser. In the first instance, the cover is designed to block off 90° of the vent diffuser and four covers will completely prevent airflow from the vent diffuser. The cover may, instead, be designed to block off 120° of the round vent diffuser. In this instance, three covers may be used to completely prevent airflow from the vent diffuser.

Referring to FIGS. 20-23*b* there is shown a second embodiment of a vent cover in accordance with the present invention and generally indicated at 110. Vent cover 110 is substantially identical to vent cover 10 and includes a flexible member 120 positionable to be seated over an exterior surface of a vent diffuser and to thereby obstruct a region of the diffuser to substantially prevent airflow from that obstructed region. Flexible member 120 has an inner surface 122, an outer surface 124, an interior edge 126, an exterior edge 128 and side edges 130 extending between the interior and exterior edges 126, 128. Flexible member 120 tapers from exterior edge 128 to interior edge 126 and has the shape of a truncated triangle. Flexible member 120 comprises two gently curved or pillowed regions, namely first region 132 and second region 134 that meet along a shallow ridge 136. The term "pillowed" is used to describe a cross-sectional shape that is generally planar but includes a very gentle curve. This pillowed-type design gives cover 110 an increased strength and flexibility that enables it to be detachably engaged with a wide variety of different manufacturer's ceiling vent diffusers. As with vent cover 10, this configuration of first and second regions 132, 134 also gives flexible member 120 a spring memory which aids in keeping it interlockingly engaged with a ceiling diffuser.

Figure 20A:
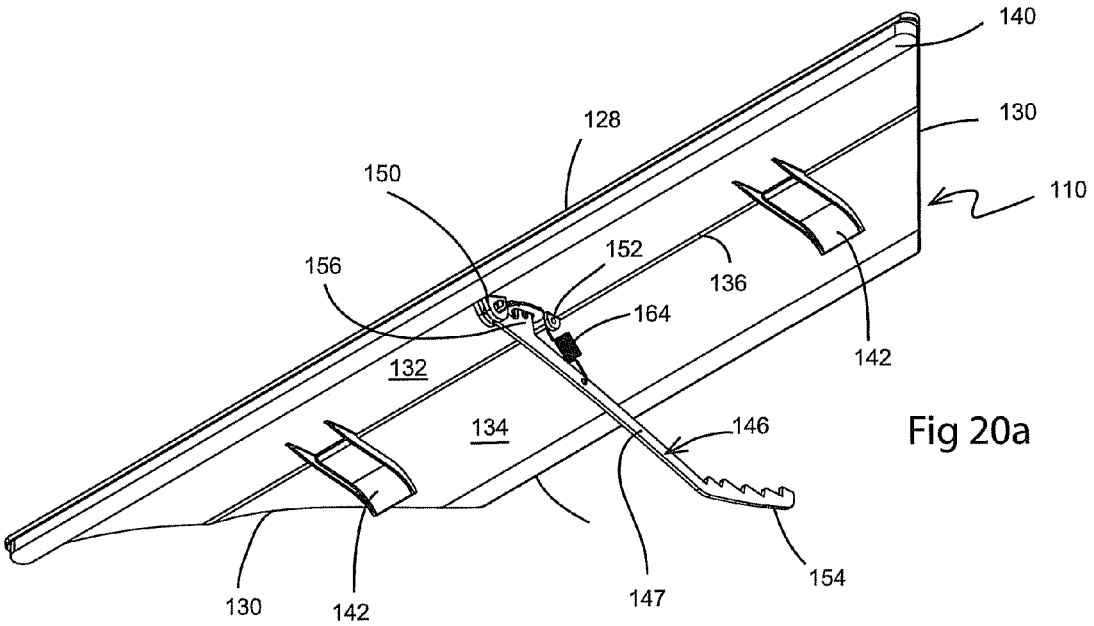
FIG. 20*a* is a perspective rear view of a second embodiment of a vent cover in accordance with the present invention showing a second type of locking mechanism provided on the cover.
Figure 20B:
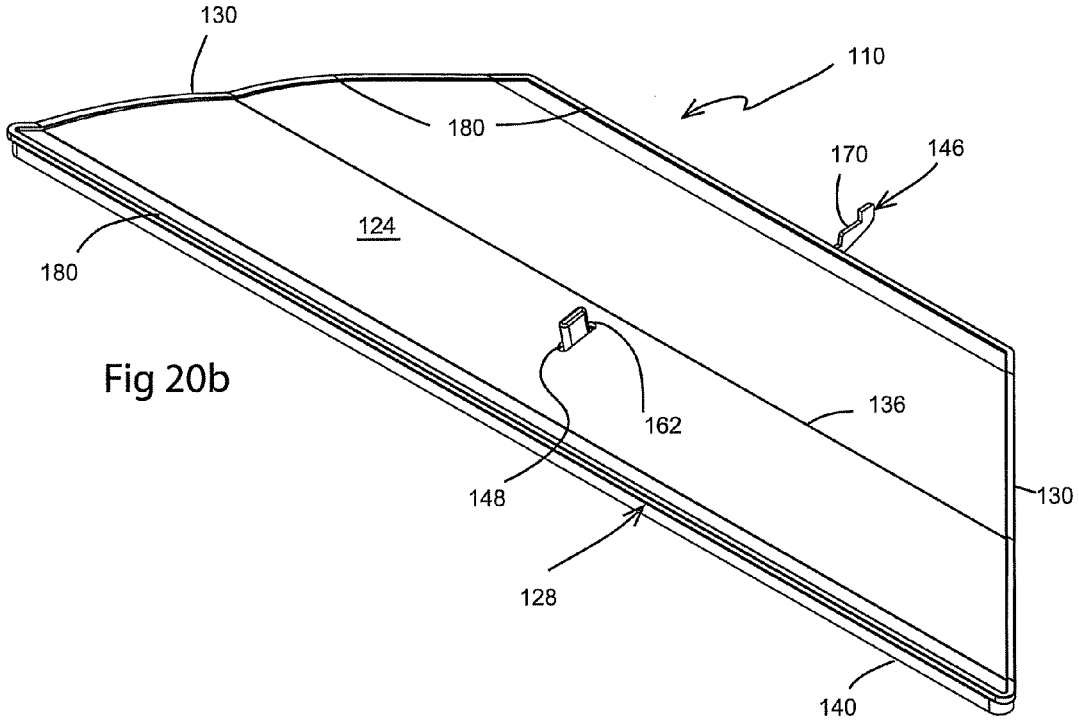
FIG. 20*b* is a perspective front view of the cover of FIG. 20*a;*
Figure 21:
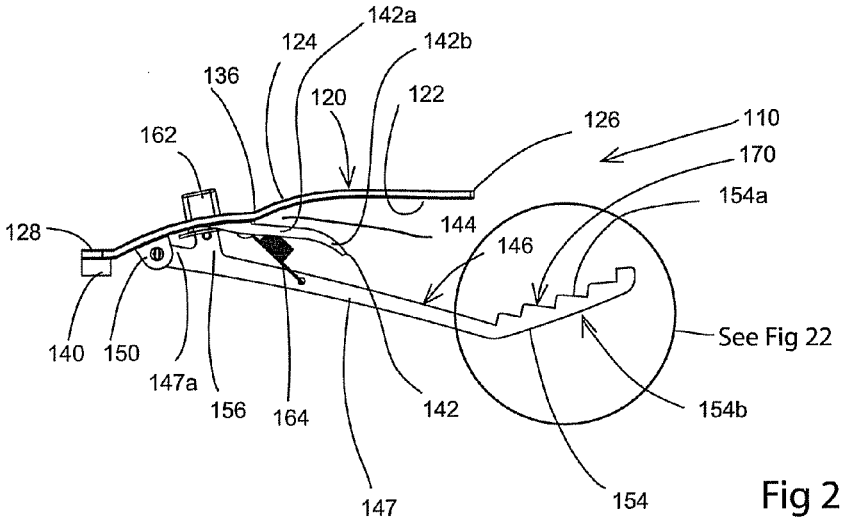
FIG. 21 is a side view of the vent cover of FIG. 20*a;*

As best seen in FIG. 20*b*, cover 110 further preferably includes a lip 180 on outer surface 124 and which extends around the periphery of cover 110 and is disposed adjacent interior edge 126, exterior edge 128 and side edges 130. Lip 180 projects for a distance above outer surface 124. It will be understood that lip 180 could also be configured to project for a distance below inner surface. Lip 180 provides additional strength to cover 110. A sealing member, such as adhesive foam strip 140, may be secured to inner surface 122 and along exterior edge 128. It will be understood, however, that the sealing member 140 may be omitted without departing from the scope of the present invention.

Cover 110 is provided with a locking mechanism which aids in detachably retaining flexible member 120 on a vent diffuser. The locking mechanism includes a connector member and a hook member. The connector member preferably engages a region on a vane of the vent diffuser and the hook member preferably engages a different region of that vane.

In particular, the connector member comprises one or more tabs 142 which are each fixedly secured to the inner surface 122 and extend outwardly therefrom. Tabs 142 serve much the same function as tabs 42 but the configuration of tabs 142 differs from that of tabs 42. Tabs 142 extend outwardly from inner surface 122 and at an angle relative thereto and extend toward interior edge 126. A gap 144 is defined between tab 142 and inner surface 122. Tabs 142 in combination with inner surface 122 of flexible member 120 are configured and oriented so as to receive an edge of one of the vanes of a ceiling diffuser in gap 144 and to retain the same therein. Tabs 142 preferably are about 2-4 inches (5½ cm-7½ cm) in length and are about 1 inch (2.5 cm) in width. Each tab 142 includes a first section 142*a* that is spaced from inner surface 122 and is generally planar along its entire length. Preferably, first section 142*a* is between ¾ inch to 2 inches (2 cm-4 cm) long. First section 142 extends outwardly from inner surface 122 at an angle of about 10° to 15° relative to inner surface 122. The second region 142*b* of each tab 142 curves downwardly and outwardly away from inner surface 122 so that the tip region is at an angle of about 20° relative to inner surface 122. The shape and increased angle of the curved second region 142 aids in helping tab 142 slide more easily into position on the vanes of a wide variety of different manufacturer's diffuser vanes. Tabs 142 are used to secure flexible member 120 to a region of a vane of a ceiling vent diffuser in substantially the same way as tabs 42. It will be understood that other suitable mechanisms for connecting the flexible member to one of the vanes in opposition to the hook member 146 can also be utilized in place of the tabs 142 without departing from the scope of the present invention.

As indicated previously, the locking mechanism on cover 110 also includes a hook member 146 which is biased toward inner surface 122. In this second embodiment, hook member 146 is biased toward inner surface 122 by a spring 164. Hook member 146 is substantially identical to hook 46 and includes one or more mounting brackets 150, 152 which secure hook member 146 to inner surface 122. Particularly, mounting brackets 150 are disposed proximate an aperture 148 (FIG. 20*b*) defined in flexible member 120. Hook member 146 is, again, a generally L-shaped member having a shaft 147 with a first end 147*a* that is pivotally secured to mounting brackets 150, 152 and thereby to inner surface 122. The second end of shaft 147 comprises a leg 154 that extends inwardly toward inner surface 122 at an angle of between 80 degrees and 120 degrees relative to shaft 147. It will be understood that leg 154 may be is disposed at any other suitable angle relative to shaft 147 without departing from the scope of the present invention. Hook member 146 further includes an arm 156 extending inwardly from shaft 147 and toward inner surface 122. Arm 156 is spaced a distance along shaft 147 from first end 147*a* and extends outwardly from shaft 147 and at an angle of between 70 degrees and 120 degrees relative thereto. Again, it will be understood that arm 156 may be disposed at other suitable angles relative to shaft 147 without departing from the scope of the present invention. An end of arm 156 projects through aperture 148 of flexible member 120 and extends for a short distance beyond outer surface 124 thereof. A cap 162 preferably is provided on the end of arm 156, although this cap 162 may be omitted. Cap 162 may be manufactured from molded plastic or any other suitable material.

As with the previous embodiment, the end of the arm 156 that projects beyond outer surface 124 is used to disengage hook member 146 from its interlocking engagement with a diffuser. As indicated previously, the locking mechanism further includes a spring 64 which is secured at one end to mounting bracket 152 and at another end is received through a hole in shaft 147. Spring 164 keeps leg 154 of hook member 146 biased toward inner surface 122 of flexible member 120 and thereby keeps cover 110 retained on a ceiling diffuser once engaged therewith.

In accordance with a specific feature of the present invention, hook member 146 differs from hook 46 in that leg 154 is provided with a plurality of discrete engagement regions along the inside edge 154*a* thereof. Each separate engagement region comprises two faces that are set at an angle relative to each other and are oriented so that an edge of one of the vanes of a ceiling vent diffuser is captured in that angled region between the two faces. Different manufacturer's diffuser vanes are differently configured and the plurality of discrete engagement regions on hook member 146 ensures that edges of these differently configured vanes will be able to be engaged by a suitably situated and angled one of these engagement regions. One brand of diffuser will have a vane captured in the angled region of one engagement region while another brand of diffuser will have a vane captured in the angled region of a different engagement region. Thus, the same cover 110 can be used to affect airflow on a wide variety of different manufacturer's products.

Figure 22:
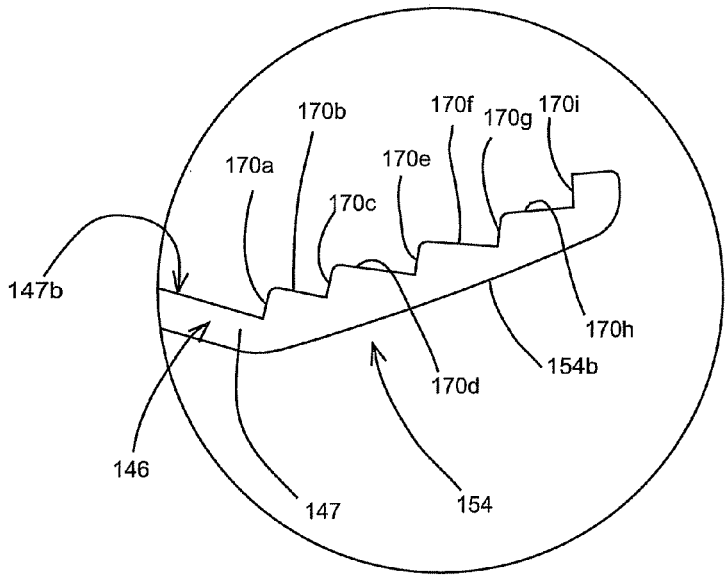
FIG. 22 is an enlarged side view of the highlighted region of FIG. 21.
Figure 23A:
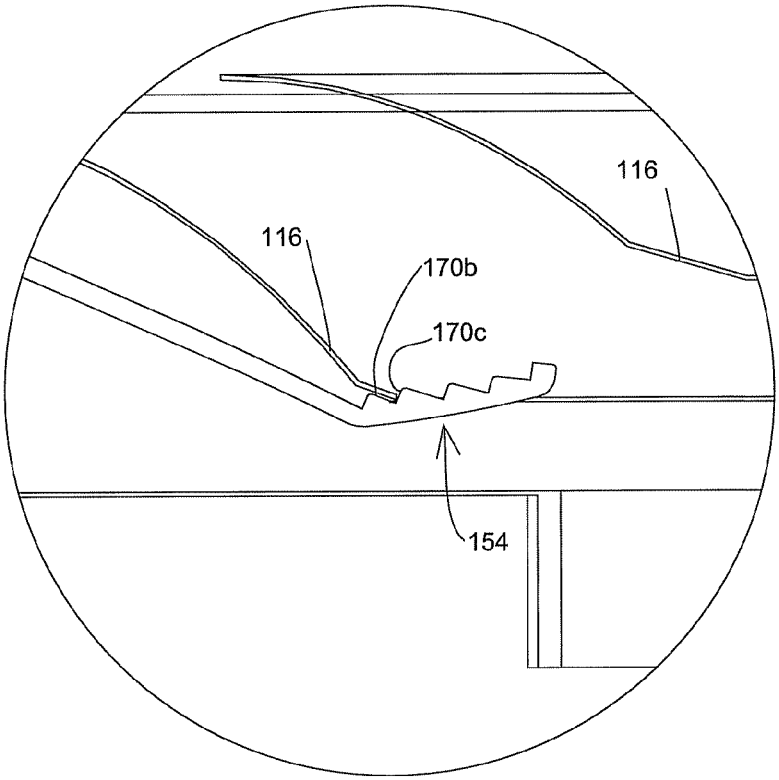
FIG. 23*a* is an enlarged side view of the highlighted region of FIG. 21 and showing a vane of a first diffuser captured in the stepped hook member of the cover.
Figure 23B:
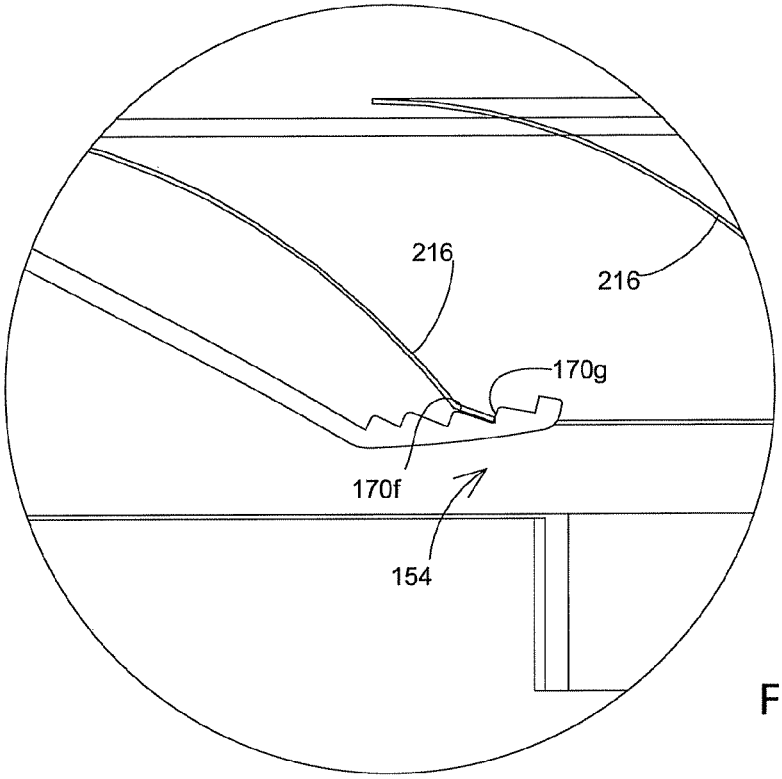
FIG. 23*b* is an enlarged side view of the highlighted region of FIG. 21 and showing a vane of a differently configured second diffuser captured in a different location in the stepped hook member of the cover.
Figure 23C:
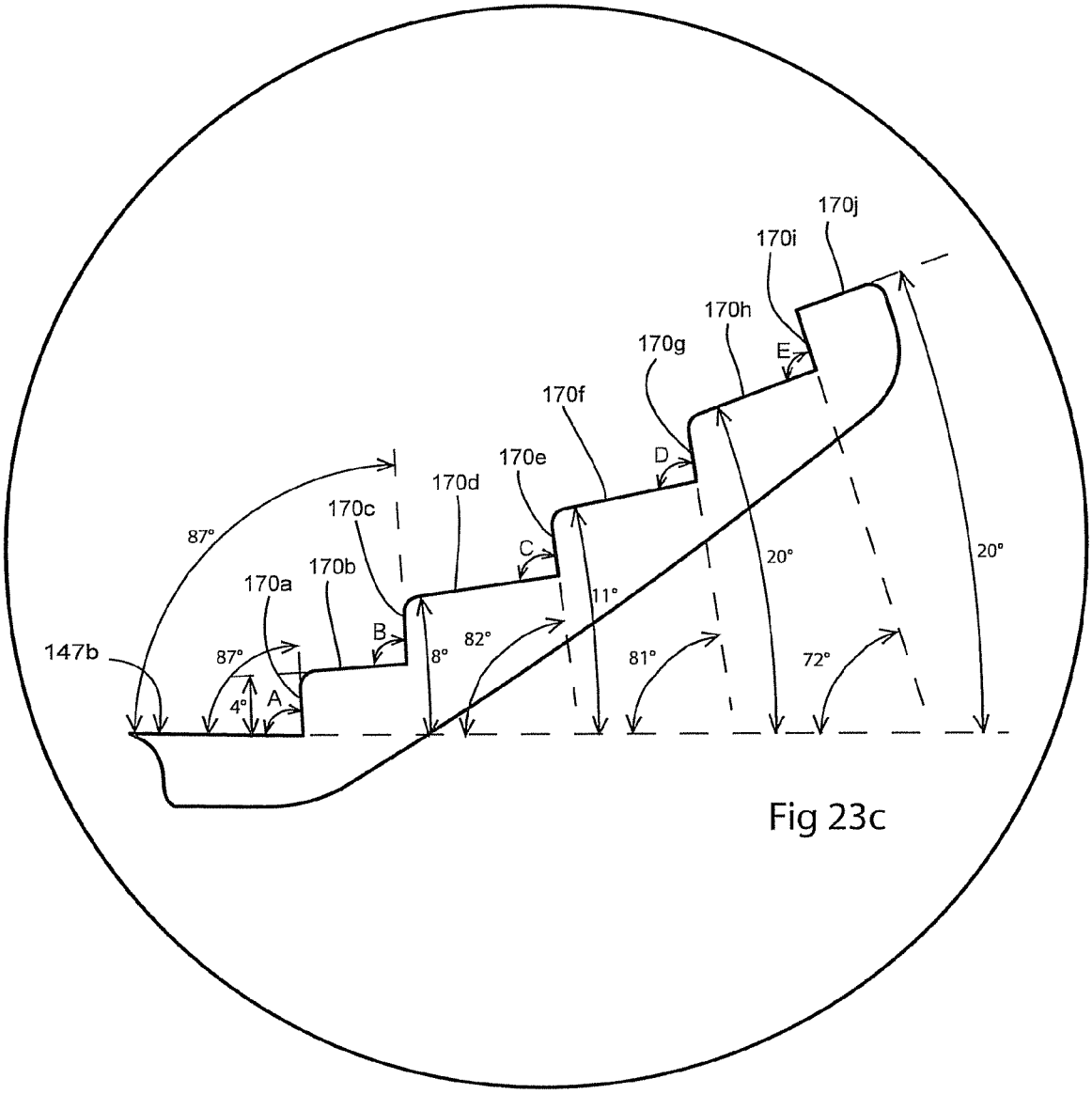
FIG. 23*c* is an enlarged side view of the highlighted region of FIG. 21 showing the angles between the various faces on the stepped hook member.
Figure 24:
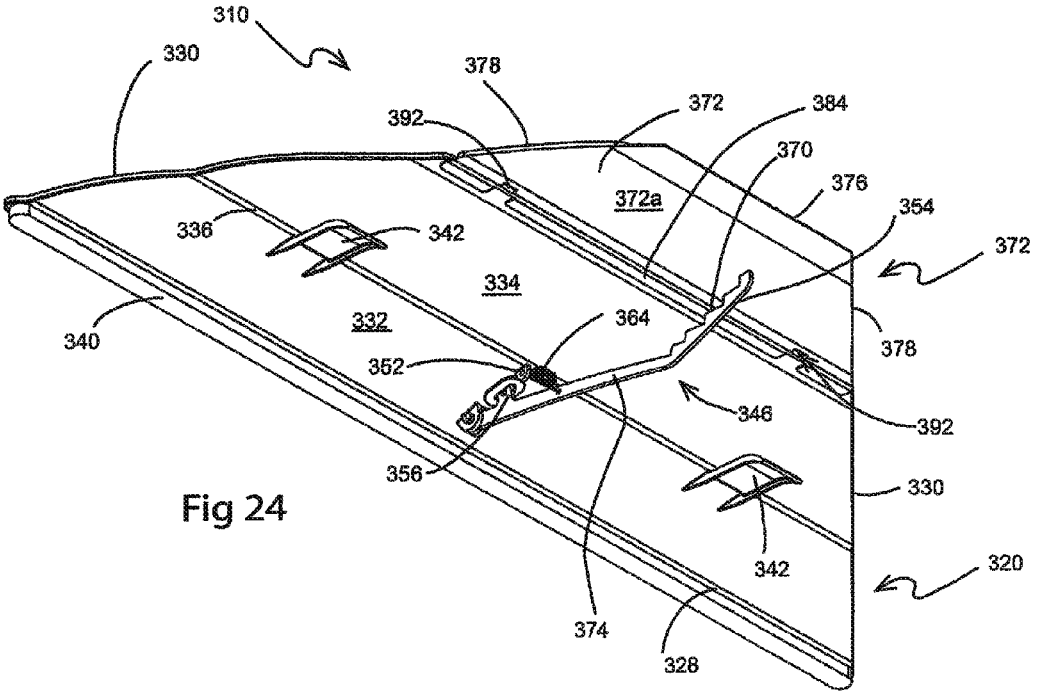
FIG. 24 is a perspective rear view of a third embodiment of a cover in accordance with the present invention and showing an extension member engaged therewith.

The nature of the specially configured hook member 146 is illustrated in greater detail in FIGS. 22-23*b*. All of the faces of the plurality of engagement regions are provided on inside edge 154*a* of leg 154. The outside edge 154*b* thereof is free of such faces. The specific number of discrete engagement regions provided on leg 154 and the length of the faces and the size of the angles that comprise the same may be varied without departing from the scope of the present invention. In a preferred embodiment of the invention, shown in FIG. 23*c*, inside edge 154*a* is provided with a first face 147*b* that is essentially a section of the inside edge of shaft 147. Inside edge 154*a* further includes a second face 170*a*, a third face 170*b*, a fourth face 170*c*, a fifth face 170*d*, a sixth face 170*e*, a seventh face 170*f*, an eighth face 170*g*, a ninth face 170*h*, a tenth face 170*i* and an eleventh face 170*j*.

Referring to FIG. 23*c* it will be seen that second face 170*a* preferably is disposed at an angle of 87° relative to first face 147*b*; third face 170*b* preferably is disposed at an angle of 4° relative to first face 147*b*; fourth face 170*c* is disposed at an angle of 87° relative to first face 147*b*; fifth face 170*d* preferably preferably is disposed at an angle of 8° relative to first face 147*b*; sixth face 170*e* preferably is disposed at an angle of 82° relative to first face 147*b*; seventh face 170*f* preferably is disposed at an angle of 11° relative to first face 147*b*; eighth face 170*g* preferably is disposed at an angle of 81° relative to first face 147*b*; ninth face 170*h* preferably is disposed at an angle of 20° relative to first face 147*b*; tenth face 170*i* preferably is disposed at an angle of 72° relative to first face 147*b*; and eleventh face 170*j* preferably is disposed at an angle of 20° relative to first face 147*b*. It will be understood that these various angles are provided by way of example only. Other suitable angles between the first face 147*b* and the second through eleventh faces 170*a*-170*j* may be used without departing from the scope of the present invention.

As indicated above, second face 170*a* extends outwardly from first face 147*a* and is disposed at a first angle "A" (FIG. 22) relative thereto. The first face 147*b* and second face 170*a* form a first engagement region and an edge of a diffuser vane may be captured in the first angled region "A" between first face 147*b* and second face 170*b*.

Inside edge 154*a* is further provided with a second engagement region formed by third face 170*b* and fourth face 170*c* which are disposed at a second angle "B" relative to each other. An edge of the diffuser vane may be received in this second angled region "B" between third and fourth faces 170*b*, 170*c*. It should be noted that third face 170*b* preferably is substantially continuous with first face 170*a*. Thus, second engagement region is positioned on inside edge 154*a* adjacent first engagement region. Second engagement region may, however, be spaced a distance from first engagement region.

Inside edge 154*a* is further provided with a third engagement region disposed adjacent second engagement region. Third engagement region comprises fifth face 170*d* and sixth face 170*e* that are disposed at a third angle "C" relative to each other. The edge of the diffuser vane may be engaged in this third angled region "C" between fifth and sixth faces 170*d*, 170*e*.

Inside edge 154*a* is further provided with a fourth engagement region disposed adjacent third engagement region. Fourth engagement region comprises seventh face 170*f* and eighth face 170*g* that are disposed at a fourth angle "D" relative to each other. The edge of the diffuser vane may be engaged in this fourth angled region "D" between seventh and eighth faces 170*f*, 170*f*.

Inside edge 154*a* is further provided with a fifth engagement region disposed adjacent fourth engagement region. Fifth engagement region comprises ninth face 170*h* and tenth face 170*i* that are disposed at a fifth angle "E" relative to each other. The edge of the diffuser vane may be engaged in this fifth angled region "E" between ninth and tenth faces 170*h*, 170*i*.

All of these different faces 170*a*-170*j* and the various angles between them provide cover 110 with a hook member 146 that appears to be stepped along the inside edge 154*a* of leg 154. As indicated previously, these five engagement regions on leg 154 may be utilized by an installer to secure cover 110 to a wide range of differently configured diffusers. The stepped hook member 146 enables cover 110 to engage diffusers that have vanes which are spaced closer together or further away from each other, or that extend to varying distances and at different angles into the interior of the diffuser.

It will be understood that the angles between the various faces indicated above are by way of example only. Other suitable stepped arrangements with different sized angles between the various faces could be utilized depending on the specifications of the diffusers manufactured by different manufacturers. Other stepped configurations are contemplated to fall within the scope of the present invention.

FIG. 23*a* shows cover 110 engaged with a vane 116 of a first diffuser (not shown) and FIG. 23*b* shows cover 110 engaged with a vane 216 of a second and differently configured diffuser. Vane 116 is captured by the second engagement region on leg 154, i.e. in the second angled region "B" defined by third face 170*b* and fourth face 170*c*. Vane 216 is captured by the fourth engagement region on leg 154, i.e., vane 216 is received in the fourth angled region "D" between seventh face 170*f* and eighth face 170*g*. As is evident from these figures, vanes 116 or 216 become captured by the different engagement regions of hook member 146 based on the distance between the vanes and the angle that those vanes are oriented at in the two different diffusers. The methodology of engaging cover 110 onto a diffuser of any configuration and disengaging the same therefrom is substantially the same as was described with reference to cover 10. Tab 142 captures a first edge of a vane in the gap between tab 142 and inner surface 122 of cover 110. Leg 154 of hook member 146 is engaged over a second edge 116, 216 of that same vane or of another vane in the diffuser and is thereby retained adjacent the exterior surface of the diffuser.

Figure 25:
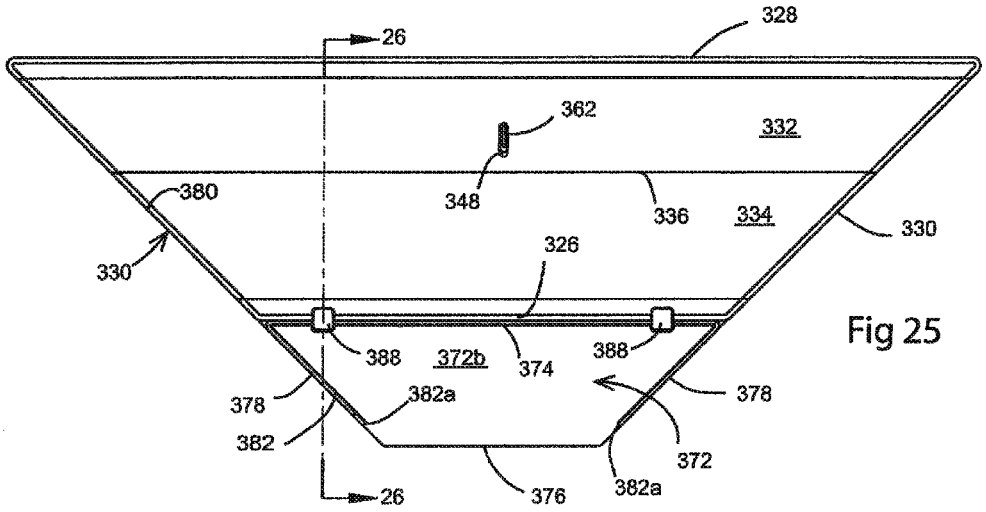
FIG. 25 is a front elevational view of the cover of FIG. 24.
Figure 26:
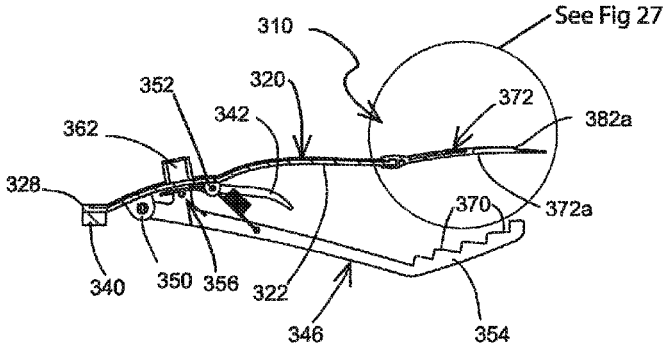
FIG. 26 is a cross-sectional side view of the cover taken through line 26-26 of FIG. 25.

Referring now to FIGS. 24-30 there is shown a third embodiment of a vent cover in accordance with the present invention and generally indicated at 310. Cover 310 is substantially identical to cover 110 in its structure, function and method of use with the exception that cover 310 also includes an extension member 372. Vent cover 310 includes a flexible member 320 substantially identical to flexible member 220, Flexible member 320 includes an inner surface 322, an outer surface 324, an interior edge 326 an exterior edge 328 and side edges 330 extending between the interior and exterior edges 326, 328. Flexible member 320 tapers from exterior edge 328 to interior edge 326 and has the shape of a truncated triangle. Flexible member 320 comprises two gently curved or pillowed regions, namely first region 332 and second region 334 that meet along a shallow ridge 336. As best seen in FIG. 25, cover 310 further includes a lip 380 on outer surface 324 and which extends around the periphery of cover 310 and is disposed adjacent interior edge 326, exterior edge 328 and side edges 330. Lip 380 projects for a distance above outer surface 324 and provides additional strength to cover 110. A sealing member, such as adhesive foam strip 340, may be secured to inner surface 322 and along exterior edge 328.

Cover 310 is provided with a locking mechanism which aids in detachably retaining flexible member 320 on a vent diffuser. The locking mechanism includes a connector member and a hook member. The connector member may engage a region on a vane of the vent diffuser and the hook member may engage a different region of that vane. The connector member comprises one or more tabs 342 which are each fixedly secured to the inner surface 322 and extend outwardly therefrom. Tabs 342 are substantially identical in structure and function to tabs 142. Hook member 346 is engaged with one or more mounting brackets 350 which secure hook member 346 to inner surface 322. Hook member 346 is a generally L-shaped member having a shaft 347 that is pivotally secured to mounting brackets 350. Shaft 347 includes a leg 354 that extends inwardly toward inner surface 322 in substantial the same manner as leg 154. Hook member 346 further includes an arm 356 extending inwardly from shaft 347 and toward inner surface 322. An end of arm 356 projects through aperture 348 (FIG. 28) of flexible member 320 and extends for a short distance beyond outer surface 324 thereof. A cap 362 preferably is provided on the end of arm 356, although this cap 362 may be omitted. The end of the arm 356 that projects beyond outer surface 324 is used to disengage hook member 346 from its interlocking engagement with a diffuser. Locking mechanism includes a spring 364 which is secured at one end to mounting bracket 352 and at another end is received through a hole in shaft 347. Spring 364 keeps leg 354 of hook member 346 biased toward inner surface 322 of flexible member 320 and thereby keeps cover 310 retained on a ceiling diffuser once engaged therewith. Hook member 346 is substantially identical in structure and function to hook member 146 and includes a number of faces 370 on engagement regions that are substantially identical in structure and function to faces 170*a*-170*j*.

As indicated previously, cover 310 is substantially identical to cover 110 in its structure, function and method of use with the exception that cover 310 also includes an extension member 372. Extension member 372 is selectively detachably engageable with flexible member 320 to increase the overall size of cover 310. Specifically, extension member 372 is detachably engaged with flexible member 320 so as to increase the cover's length. The engagement of extension member 372 with flexible member 320 is desirable when the diffuser to which cover 310 is to be attached is larger in size. So, for example, if typical diffusers have three sets of vanes, a larger diffuser could have four sets of vanes. Cover 310 is able to be removed from the larger diffuser at a later date and extension member 372 may then be detached from its engagement with flexible member 320. This disengagement reduces the cover's overall size to its original size and cover 310 may then be used again on smaller diffusers.

Extension member 372 has a first end 374, a second end 376 and side edges 378. Extension member 372 also has an inner surface 372*a* (FIG. 24) and an outer surface 372*b* (FIG. 25). As is evident from FIG. 26, first end 374 of extension member 372 is of substantially the same width as interior edge 326 of cover 310, where the width is that distance between the opposed side edges of the two components. Second end 376 is of a substantially smaller width so that extension member 372 tapers from first end 374 toward second end 376 thereof. Effectively, extension member 372 has a truncated triangular shape.

Figure 28:
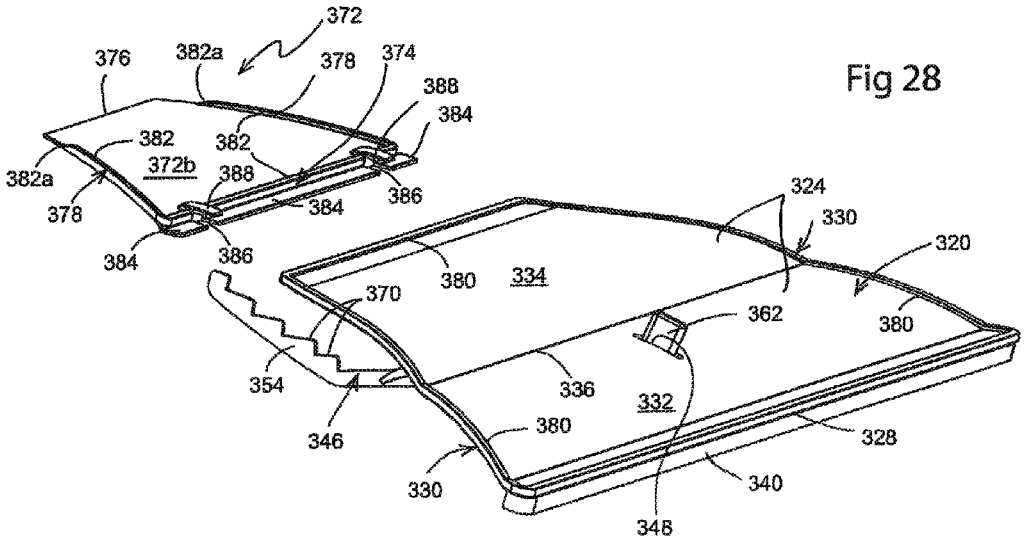
FIG. 28 is an exploded perspective front view of the cover and the extension member.

In accordance with a feature of the present invention and as best seen in FIG. 28, a lip 380 is provided on the outer surface 324 substantially around the entire periphery of cover 310. Lip 380 therefore extends around the periphery of interior edge 326, exterior edge 328, and side edges 330 thereof. Similarly, a lip 382 is provided on outer surface 372*b* of extension member 372. Lip 382 extends around a portion of the periphery of extension, specifically along first end 374 and most of side edges 378. Lip 382 does not extend along a region of each side edge 378 proximate second end 376 and along second end 376. Additionally, as is evident from FIG. 28, lip 382 tapers at ends 382*a*. This configuration gives extension member 372 a sleek second end 376 that conforms more readily to a diffuser's profile and aids in helping cover 310 to blend into diffuser so that the cover's presence is not readily detected by the casual observer.

In accordance with a specific feature of the present invention, extension member 372 is configured to interlockingly engage cover 310 and to be retained thereon until it is actively disengaged by a user. FIG. 28 shows some of the components that are provided on extension member 372 to interlockingly engage cover 310. First end 374 of extension member 372 includes a lower flange 384 that runs along a lowermost region of first end. Lower flange extends outwardly from lower surface 372*a* of extension member 372 and extends outwardly beyond first end 374. One or more slots 386 are provided in lower flange 384, each slot being spaced a distance inwardly from one of the side edges 378 of extension member 372. One or more upper flanges 388 extend outwardly from upper surface 372*b* of extension member 372 and these flanges 388 extend beyond first end 374 in the same general direction as lower flange 384. It should be noted that each upper flange originates in upper surface 372*b* and extends over lip 382. Since extension member 372 is a molded plastic product, upper surface 372*b*, upper flange 388 and lip 382 are all integrally joined to each other. Each upper flange 388 is provided in the region immediately above one of slots 386 in lower flange 384. When viewed from the side, a gap 390 is defined between upper flange 388 and lower flange 384.

Figure 27:
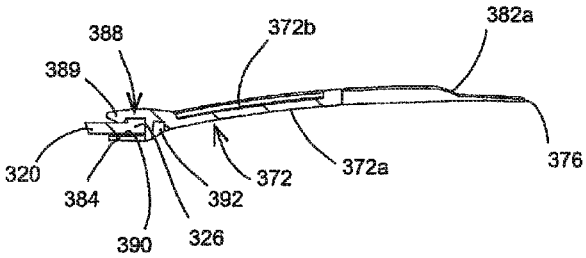
FIG. 27 is an enlarged side view of the highlighted region of FIG. 26.
Figure 29:
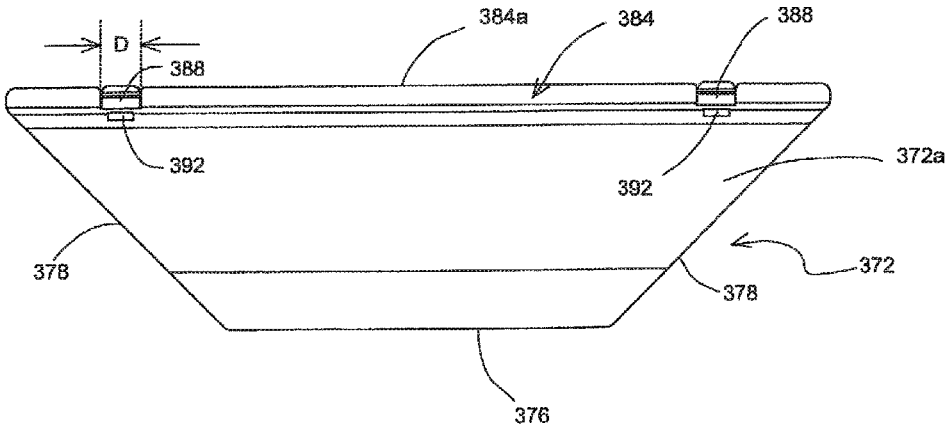
FIG. 29 is a rear elevational view of the extension member.

As best seen in FIG. 27, the outermost tip of upper flange 388 is tapered and forms an interior shoulder 389 which projects downwardly into gap 390. A slot 392 is defined in lower surface 372*a* of extension member 372, a short distance inwardly from portion of the lower flange 384 which defines slot 386. Slot 392 is in communication with gap 390 and is situated directly beneath an interior region of upper flange 388 and inwardly of shoulder 389. As shown in FIG. 29, slot 392 is provided in lower surface 372*a* of extension member 372 and is oriented substantially parallel to the outermost edge 384*a* of lower flange 384. Slots 392 extend for substantially the same distance "D" as the width of each upper flange 388.

When flexible member 320 and extension member 372 are engaged together, interior edge 326 of cover 310 is received in gap 390 between upper and lower flanges 388, 384 such that lip 382 becomes interlocked with shoulder 388 therein. Cover 310 and extension member 372 are pushed inwardly toward each other until lip 380 and interior edge 326 of cover 310 snap-fit into gap 390. Shoulder 389 interlocks with lip 380 on flexible member 320. The engagement is sufficiently strong enough that the cover 310 and extension member remain engaged therewith and the two components cannot be pulled apart from each other without taking additional steps. The engagement is strong enough that cover 310 and extension member 372 remain together during installation of cover 310 on a diffuser and during periods when air flows out of the diffuser, contacts cover 310 and extension 372 and is deflected thereby. Extension 372 is engaged with cover 310 when the user wishes to utilize cover 310 on a diffuser that is larger and includes additional vanes and openings that need to be covered during operation.

When the user wishes to disengage extension 372 from cover 310, they simply slide cover 310 and extension member 372 in opposite lateral directions relative to each other. This motion causes interior edge 326 of cover 310 to slide out of gap 390, thereby allowing cover 310 and extension member 372 to separate from each other. Alternatively, the user can insert a narrow implement, such as the head of a flathead screwdriver into slot 392 and push the same gently upwardly until the head contacts upper flange 388. This pushing motion will cause upper flange to move upwardly away from lower flange 384, thereby enlarging gap 390 to a degree sufficient to allow lip 380 to disengage from shoulder 389. The user is then able to slide interior edge 326 of cover 310 out of gap 390 in a longitudinal direction instead of a lateral direction because shoulder 389 is no longer in contact with lip 380. Cover may then be used again without the extension member 372 to cover a smaller size diffuser.

It will be understood that instead of extension member 372 being configured to engage with the interior edge 326 of flexible member 320, it may, alternatively, be configured so that it can be detachably engaged with the exterior edge 328 of flexible member. In this instance, first end 374 of extension member 372 would be of a width that is substantially the same as exterior edge 328 of flexible member 320 and second end 376 of extension member 372 would be substantially wider than the first end 374. Exterior edge 328 would be snap-fitted into gap 390 of the connector assemblies 388 and would be frictionally retained therein until extension member 372 is disengaged from flexible member 320. This configuration of extension member 372 and flexible member 320 will be engaged with a ceiling vent diffuser in substantially the same manner as the configuration in which the extension member 372 engages interior edge 326 of flexible member.

While the attached figures have illustrated the extension member 372 being engaged with flexible member 320, it will be understood that it could similarly be engaged with flexible member 20 without departing from the scope of the present invention. In fact, extension member 372 may be engaged with any of the differently configured flexible members disclosed herein. If flexible member 20, for example, is not manufactured to form a lip that will interlockingly engage with the shoulder of the upper flange, the interior or exterior edge 26, 28 of the flexible member 20 will simply be retained by friction in the gap of the connector assembly on extension member 372.

Figure 30:
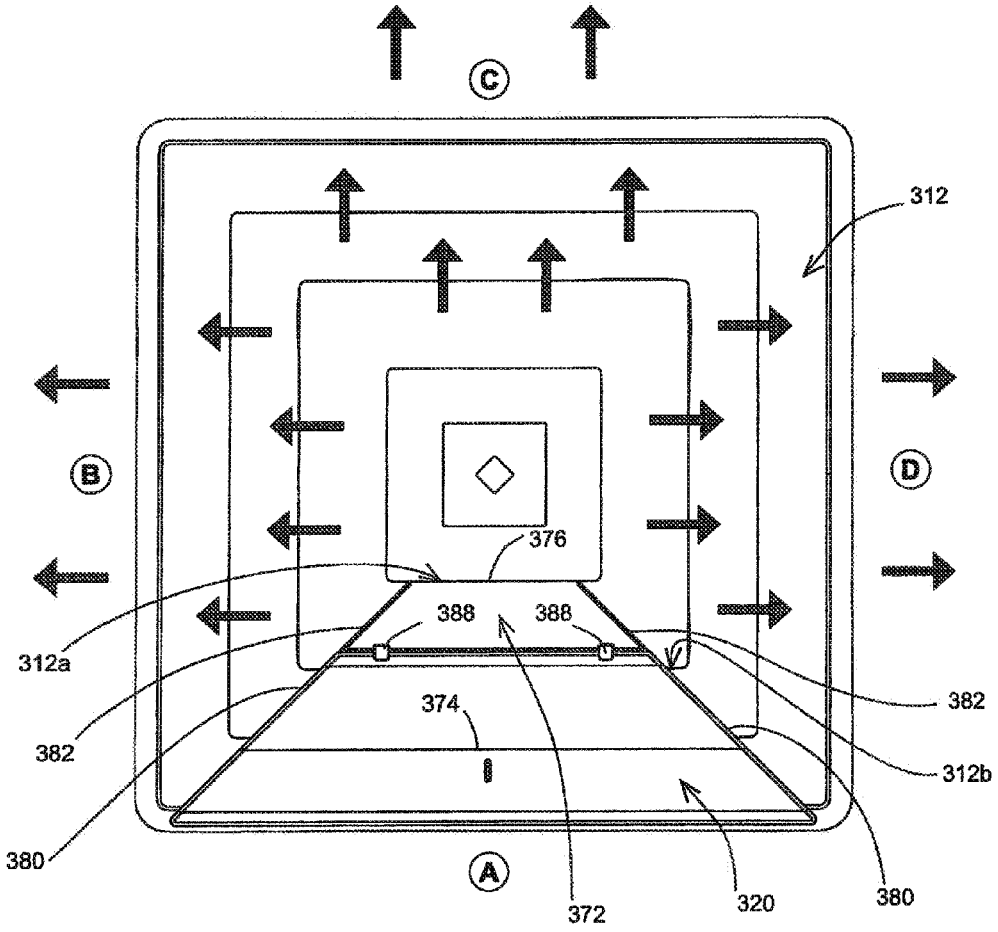
FIG. 30 is a front elevational view of a ceiling vent diffuser having the third embodiment of the vent cover in accordance with the present invention engaged therewith.
Figure 31:
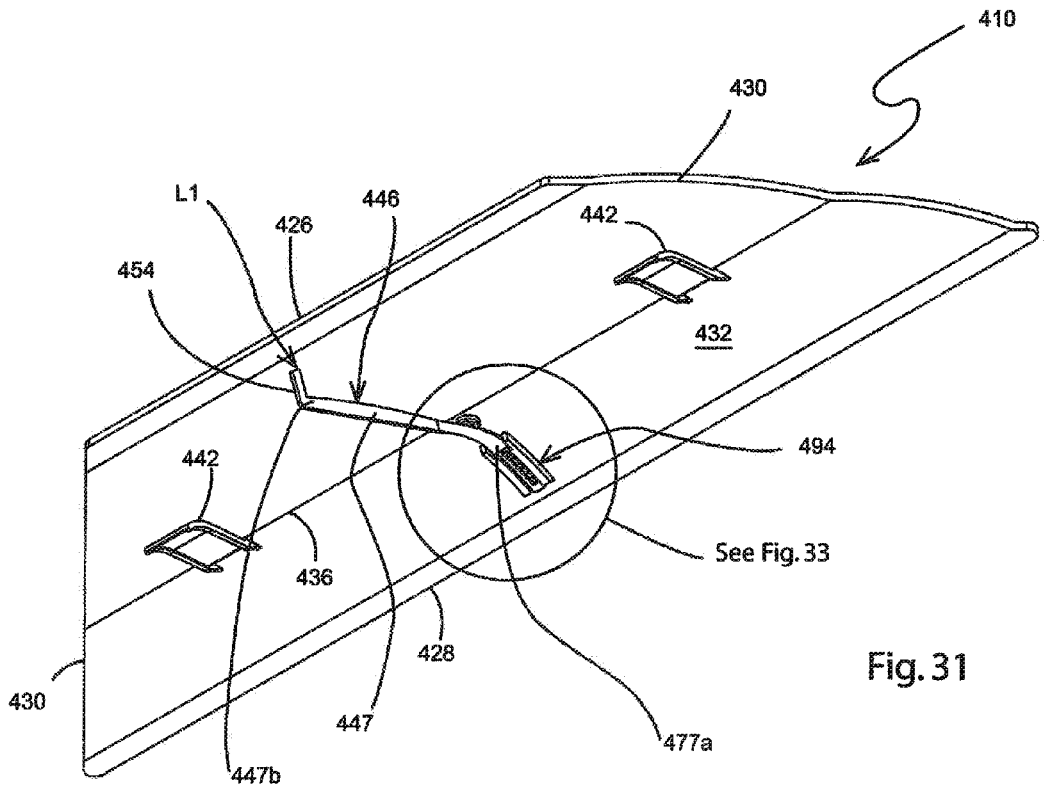
FIG. 31 is a perspective rear view of a fourth embodiment of a cover in accordance with the present invention and showing an adjustable hook member which is provided with a locking mechanism to engage the hook member in a particular position on the cover.
Figure 32:
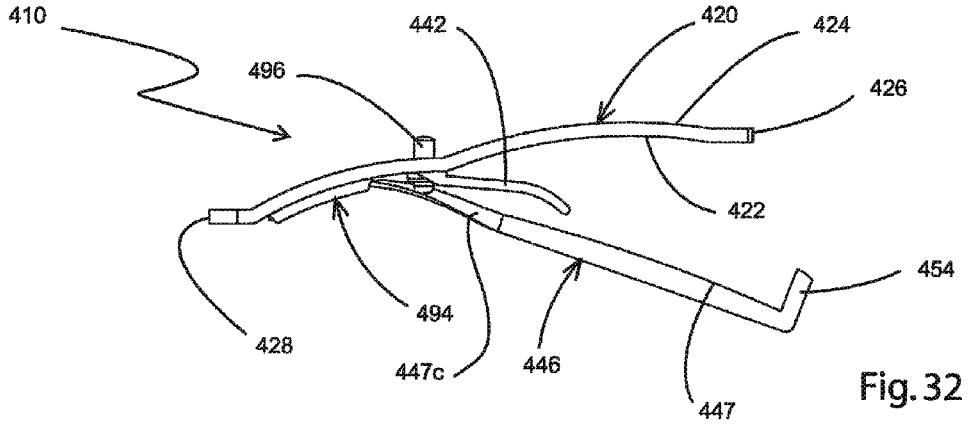
FIG. 32 is a side view of the cover of FIG. 31.

FIG. 14 shows cover 10 engaged with vent diffuser 12 and FIG. 30 shows cover 320 engaged with vent diffuser 312. As is evident from these figures, vent diffuser 312 includes one additional vane relative to diffuser 12. If cover 320 did not include extension member 372, then opening between the first vane 312*a* and the second vane 312*b* would not be obstructed and air would flow outwardly through that opening. Because of the inclusion of extension member 372 to increase the overall size of cover 320, all airflow through quadrant "A" of diffuser 312 is substantially blocked. Consequently, air flows out of the diffuser 312 through quadrants "B", "C", and "D" only. It should be noted that first end 376 of extension member 372 is slipped under the central region of diffuser 312 and is therefore not visible in FIG. 30.

Referring to FIGS. 31-35, there is shown a fourth embodiment of a vent cover according to the present invention and generally indicated at 410. Cover 410 includes a flexible member 420 having the pillowed design of cover 110 and is comprised of a first region 432 and a second region 434 which join each other along a shallow ridge 436. Cover 410 is shown free of a foam strip similar to strip 142 but it will be understood that if certain manufacturer's diffusers require it, such a strip could readily be applied to exterior edge 428 thereof. As with the previously described embodiments, cover 410 also includes an interior edge 426 and opposed side edges 430, an inner surface 422 and an outer surface 424.

In accordance with a specific feature of the present invention, cover 410 includes yet another embodiment of a locking mechanism. The locking mechanism in accordance with the present invention includes one or more tabs 442 which extend outwardly from inner surface 422 of cover 410. Tabs 442 are substantially identical in structure and function to tabs 142. The locking mechanism further includes a hook member 446 which extends outwardly away from inner surface 422 of flexible member 420. Hook member 446 includes a shaft 447 having a first end 447*a* and a second end 447*b*. A leg 454 is provided at second end 447*b* of shaft 447 and the leg 454 extends inwardly toward inner surface 422. At least a portion 447*c* of shaft 447 is curved away from inner surface. Hook member 446 is fabricated as a single piece and is configured so that it possesses an inherent spring memory which biases leg 454 toward inner surface 422. The locking mechanism further includes an adjustment mechanism 494 which is fixedly secured to inner surface 422 of flexible member 420.

Figure 33A:
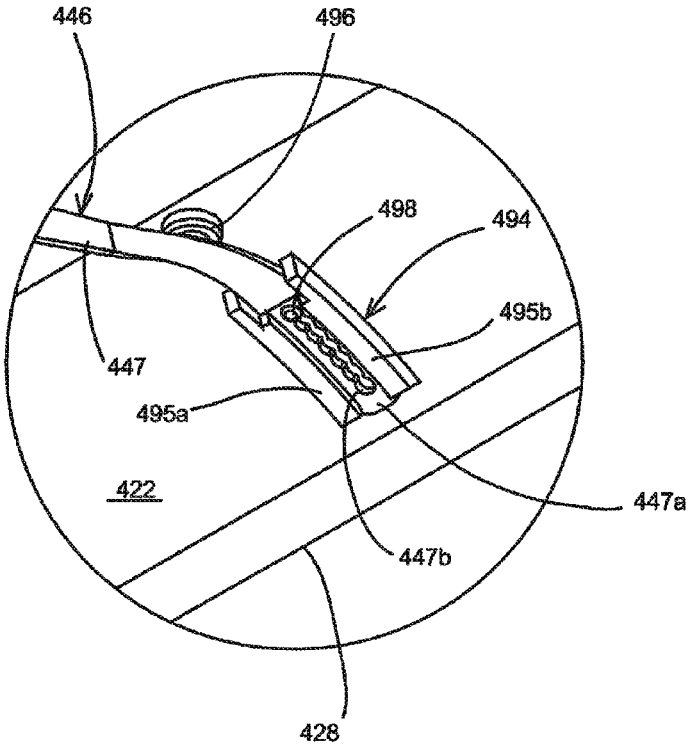
FIG. 33*a* is an enlarged rear view of the highlighted region of FIG. 31.
Figure 33B:
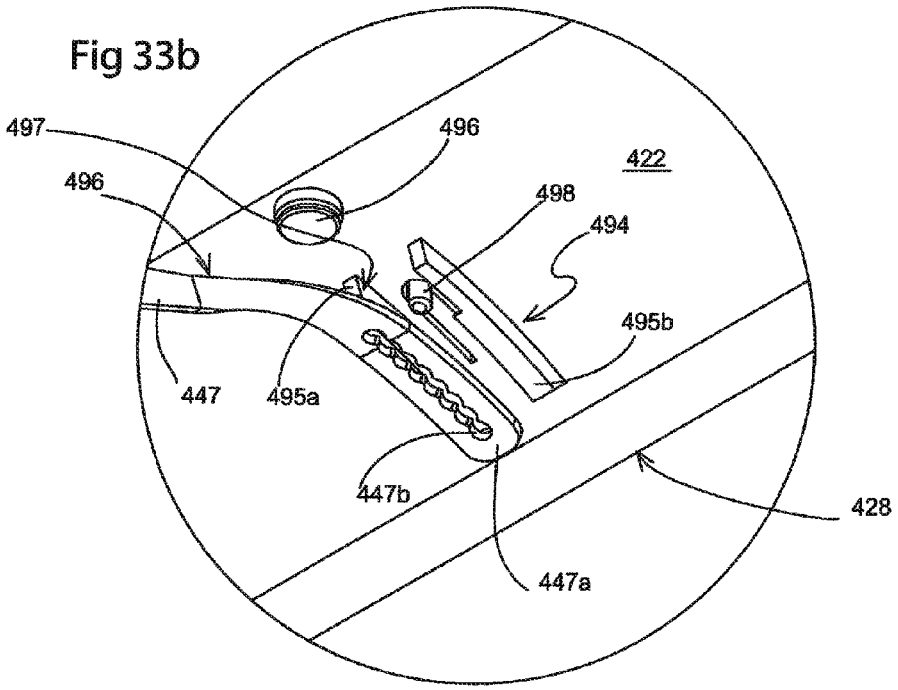
FIG. 33*b* is an enlarged rear view of the highlighted region of FIG. 31 with the hook member exploded outwardly away from the flexible member and adjustment mechanism.
Figure 34:
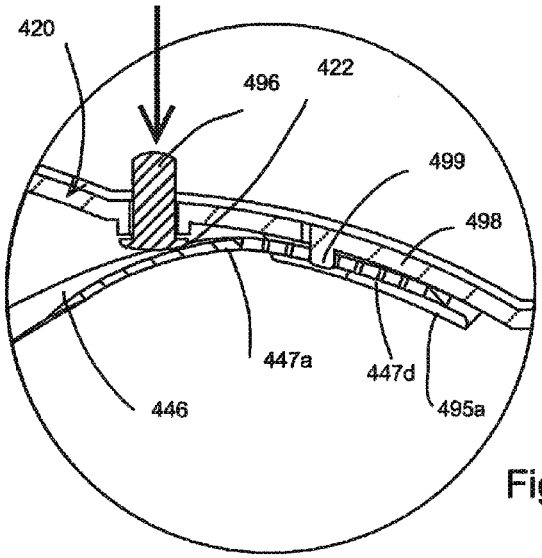
FIG. 34 is a cross-sectional side view of the locking mechanism shown in FIG. 33.

Adjustment mechanism 494 includes a first guide 495*a* and a second guide 495*b*. First and second guides 495*a*, 495*b* are disposed substantially at right angles to interior edge 426 and are spaced laterally from each other. Thus, a channel 497 is defined between first and second guides 495*a*, 495*b* and first end 447*a* of hook member 446 is received in this channel 497. An insert 498 extends between first and second guides 495*a*, 495*b*. A stop 499 extends outwardly from an outer surface of insert 498 and projects into the channel 497. As is shown in FIGS. 33*a*, 33*b*, first end 447*a* of hook member 446 defines a longitudinally extending slot 447*d* comprised of a series of circular apertures which are in communication with each other. This series of apertures provides a plurality of different positions for receipt of stop 499 therethrough.

Figure 35:
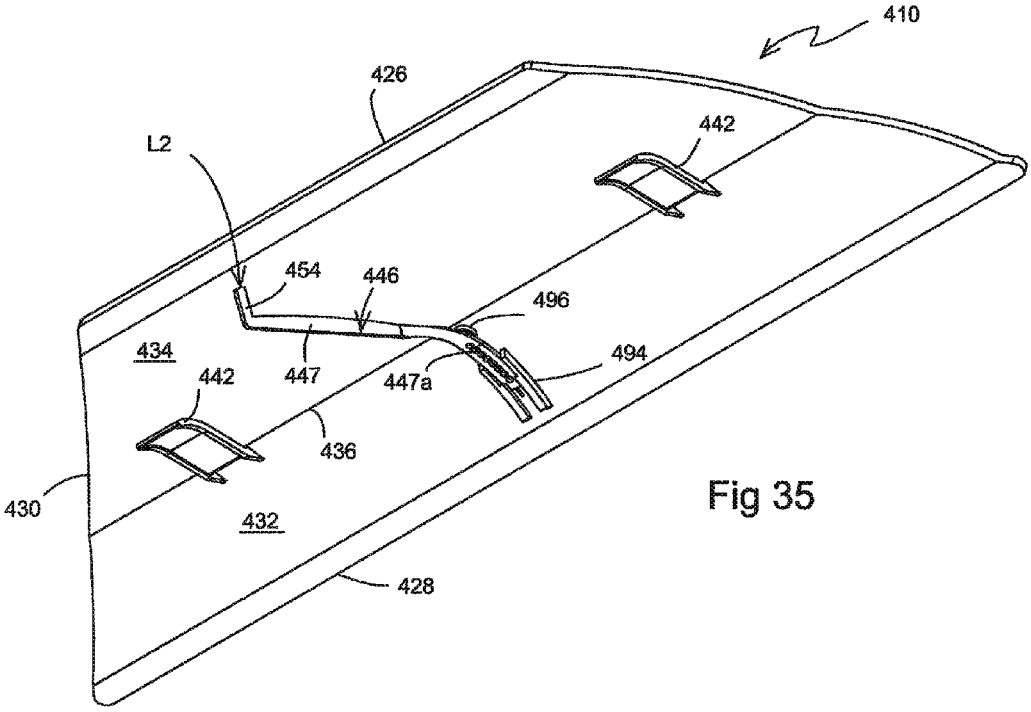
FIG. 35 is a perspective rear view of the cover of FIG. 31 with the hook member adjusted to a second position on the locking mechanism that is different to that shown in FIG. 31.

First end 447*a* of hook member 446 is engaged with adjustment mechanism 494 in such a way that hook member 446 is movable within adjustment mechanism 494 between at least a first position (FIG. 33) and a second position (FIG. 35). When hook member 446 is in the first position then leg 454 is disposed in a first location "L1" (FIG. 33) relative to interior edge 426 and to inner surface 422. Specifically, the tip of leg 454 is disposed a first distance away from inner surface 422. When hook member 446 is in the second position, then leg 454 is disposed in a second location "L2" (FIG. 35) relative to interior edge 426 and to inner surface. Specifically, the tip of leg 454 is disposed a second distance away from inner surface 422 because the curvature of hook member 426 causes the leg 454 to be moved further outwardly away from inner surface as the first end 447*a* thereof is moved toward interior edge 426. If first end 447*a* is moved once again in adjustment mechanism 494 in the opposite direction from that shown in FIG. 38, i.e., away from interior edge 426 and toward exterior edge 428, then the leg 454 will once again be moved closer to inner surface 422. This adjustability in the device enables the installer to change the effective depth (relative to inner surface 422) that leg 454 is set at in order to engage different configurations and styles of diffuser. The position of first end 447*a* of hook member 446 within adjustment mechanism 494 is adjusted by engaging stop 499 in a different one of the plurality of apertures that form slot 447*d*. The engagement of stop 499 prevents any further movement in hook member 446 without the express intervention of the installer.

Thus, when an installer discovers that they are unable to adequately engage cover 410 on a vent diffuser because leg 454 of hook member 446 is not quite in the correct position, they are able to simply release stop 499 from its engagement in a particular one of the apertures of slot 447*d*, slide first end 447*a* of hook member 446 along channel 497 and engage stop 499 in a different one of the apertures of slot 447*d*. Once hook member 446 is positioned in an appropriate location on flexible member 420 the installer can then engage cover 410 on a vane of a diffuser. This adjustability of the position of hook member 446 relative to flexible member 420 enables the user to utilize cover 410 on a wide variety of different styles and sizes of ceiling vent diffusers.

When it is desired to remove cover 410 from engagement with a vane of a diffuser, the installer simply depresses a release button 496 on outer surface 424 of cover 410. Button 496 is pushed inwardly in the direction of the arrow in FIG. 34. The movement causes hook member 446 to be pushed away from inner surface 422 of flexible member 420, thus disengaging leg 454 of hook member 446 from the vane to which it was attached.

Figure 36:
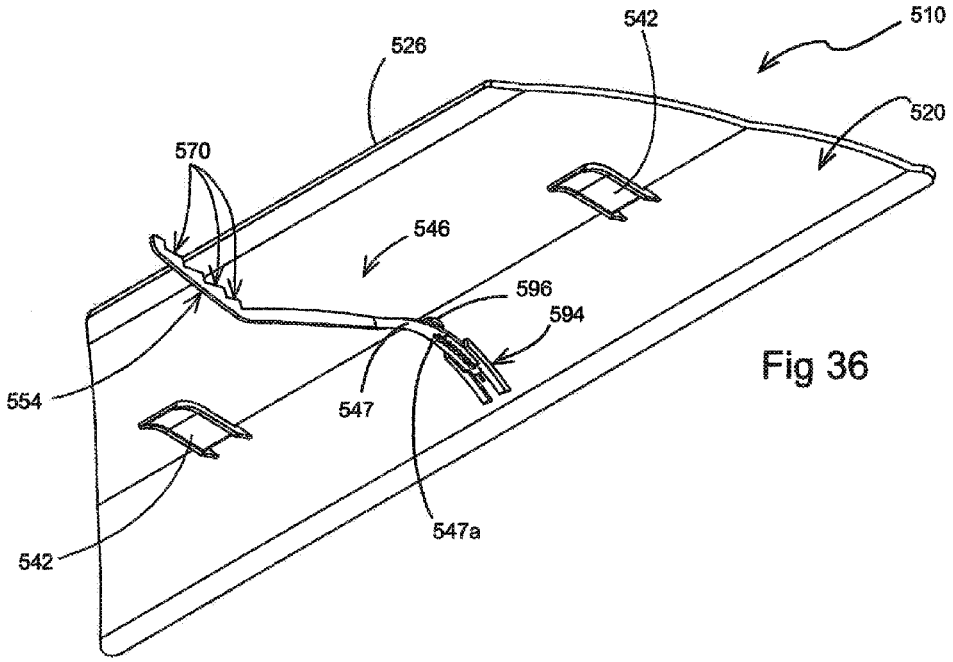
FIG. 36 is a perspective rear view of a fifth embodiment of a cover in accordance with the present invention and showing another version of an adjustable hook member.

FIG. 36 illustrates a fifth embodiment of a vent cover in accordance with the present invention and generally indicated at 510. Cover 510 is substantially identical to cover 410 with the exception that the locking mechanism provided therewith is different. The locking mechanism includes tabs 542, an adjustment mechanism 594 and a hook member 546. Tabs 542 are substantially identical in structure and function to tabs 142. Adjustment mechanism 594 is substantially identical in structure and function to adjustment mechanism 494. Hook member 546 differs from hook member 446. Hook member 546 includes a shaft 547 that is similar to shaft 447 in that while it has first end 547*a* substantially identical to first end 447*a*, its second end is provided with a leg 554 that is substantially identical to leg 154 instead of to leg 454. Adjustment mechanism 594 permits the position of hook member 546 to be adjusted so that an appropriate one of the engagement regions 570 on leg 554 will be in the correct location relative to interior edge 526 of flexible member 520 so as to engage a vane of a particular diffuser (not shown). The installer will make the appropriate adjustment of hook member 546 prior to engaging cover 510 on vane of that particular diffuser. The locking mechanism further includes a release button 596 which extends through an aperture in flexible member 520 and is accessible to the installer on the outer surface thereof. Release button 596 is substantially identical in structure and function to release button 496.

Figure 37:
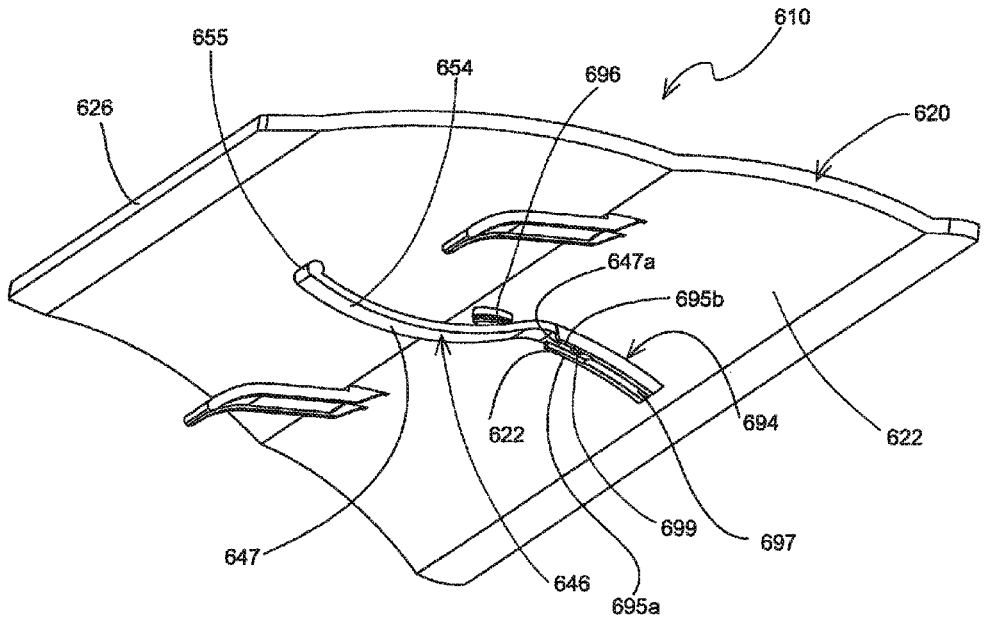
FIG. 37 is a perspective rear view of a sixth embodiment of a cover in accordance with the present invention that is configured to engage a panel-type diffuser, and showing yet another version of an adjustable hook member.
Figure 38:
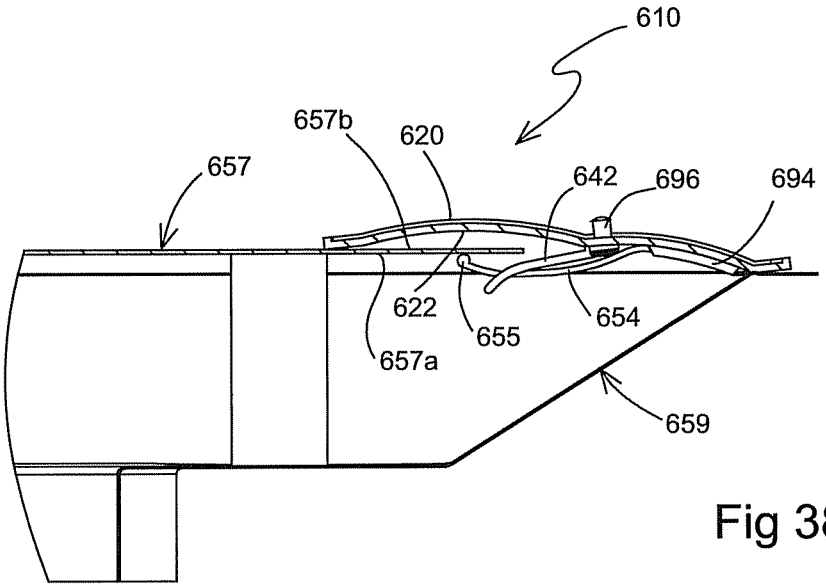
FIG. 38 is a cross-sectional side view of the sixth embodiment of the cover shown engaged with a panel-type diffuser.

FIGS. 37 and 38 show a sixth embodiment of a cover in accordance with the present invention and generally indicated at 610. Cover 610 is configured to engage a panel type diffuser 659 as opposed to a vane-type of diffuser. Cover 610 is substantially identical in structure and function to cover 510 with the exception that it once again includes a different locking mechanism. The locking mechanism includes tabs 642 that are substantially identical in structure and function to tabs 142. The locking mechanism further includes an adjustment mechanism 694 and a hook member 646. The adjustment mechanism includes first and second guides 695*a*, 695*b* which are disposed substantially at right angles to interior edge 626 of flexible member 620. A channel 697 is defined between first and second guides 695*a*, 695*b* and first end 647*a* of hook member 646 is received in channel 697. Adjustment mechanism 694 further includes a lock 699 that secures first end 647*a* of hook member 646 in any one of a number of positions within channel 697. Additionally a release button 696 is provided on cover 610. Release 696 is substantially identical to release 596 in both structure and function.

Hook member 646 also includes a differently configured second end 654 from those previously disclosed herein. In this instance, hook member 646 includes a shaft 647 with a differently configured leg 654 extending outwardly from a second end of the shaft 647 and toward inner surface 622 of flexible member 520. Specifically, leg 654 is concavely curved and disposed opposite inner surface 622 of flexible member 620. The outermost end of leg 654 includes a crossbar 655 oriented substantially at right angles to a longitudinal axis of shaft 647, although any other orientation of the crossbar relative to the longitudinal axis is considered to fall within the scope of the present invention. Crossbar 655 is configured to abut a region of the underside 657*a* (FIG. 38) of a panel 657 on a panel diffuser 659 and to clamp the flexible member 620 against the upper side 657*b* of that panel 657. A rubber covering may be applied over crossbar 655 to increase the friction between the hook member 646 and the panel 657. In this instance, tabs 642 are not necessarily used to engage the panel.

Additionally, hook member 646 preferably is manufactured so that it can slide completely out of channel 697 of adjustment mechanism 694. This allows the installer to completely detach hook member 646 from cover 610 and to replace it with a differently configured hook member such as one that includes a leg having multiple engagement regions thereon. The replacement hook member is inserted into channel 697 of adjustment mechanism 694 and is secured in an appropriate location therein so that the cover is able to be engaged with a completely differently shaped or sized diffuser. The cover 610 may therefore form part of a kit, being sold together with a range of differently configured hook members. This will enable the installer to select the best hook member for any particular type of diffuser they encounter on the job site.

It will be understood that the diffuser to which the cover of the present invention is being attached may be of any configuration. For example, the diffuser may be square or circular in shape but could be of any other shape. The cover of the present invention is configured to be complementary in shape to the particular design of diffuser to which it is to be attached. So, for example, in the substantially square diffusers illustrated herein, the longitudinal edges of the cover that are to be secured thereto are straight. If the diffuser was circular, then the edges of the cover would be curved. It will be understood that any other configuration of diffuser will be matched by a complementary configuration of the cover to be engaged therewith.

In the foregoing description, certain, terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A device for altering the airflow pattern from a vent diffuser that includes one or more vanes, an interior surface, an exterior surface and one or more openings through which air flows from the interior surface of the diffuser to the exterior surface thereof said device comprising:

a flexible member having an inner surface and an outer surface;

a locking mechanism provided on the inner surface of the flexible member and being adapted to detachably retain the flexible member on the vent diffuser such that the flexible member obstructs at least one opening in a region of the vent diffuser and thereby substantially prevents airflow from that obstructed region; and wherein the locking mechanism includes:

a hook member having a first end adjacent the inner surface of the flexible member and a second end remote therefrom; and wherein the hook member extends outwardly from the inner surface and wherein the second end of the hook member extends toward the inner surface of the flexible member and includes a first engagement region and a second engagement region, and wherein the second end of the hook member is adapted to engage one of the vanes of the vent diffuser in one of the first engagement region and the second engagement region; and an adjustment mechanism provided on the inner surface of the flexible member; wherein the adjustment mechanism defines a channel therein which extends for a distance along the inner surface of the flexible member and the channel has a length and a width and wherein the first end of the hook member is engaged in the channel of the adjustment mechanism and is selectively movable along the length of the channel and across the inner surface of the flexible member between a first position and a second position; and, when the first end of the hook member is in the first position, the second end of the hook member is disposed in a first location set at a first distance relative to the inner surface of the flexible member; and when the first end of the hook member is in the second position, the second end of the hook member is disposed in a second location set at a second distance relative to the inner surface of the flexible member.

2. The device as defined in claim 1, wherein the first engagement region comprises:

a first face; and a second face, wherein the second face is disposed at a first angle relative to the first face; and wherein the first engagement region is adapted to selectively receive a first edge of the one of the vanes of the vent diffuser in a first angled region between the first and second faces.

3. The device as defined in claim 2, wherein the second engagement region comprises:

a third face; and a fourth face, wherein the fourth face is disposed at a second angle relative to the third face; and wherein the second engagement region is adapted to selectively receive the first edge of the one of the vanes of the vent diffuser in a second angled region between the third and fourth faces.

4. The device as defined in claim 3, further comprising a third engagement region that is adapted to selectively engage the first edge of the one of the vanes of the vent diffuser therein, and wherein the third engagement region comprises:

a fifth face; and a sixth face, wherein the sixth face is disposed at a third angle relative to the fifth face; and wherein the third engagement region is adapted to selectively receive the first edge of the one of the vanes of the vent diffuser in a third angled region between the fifth and sixth faces.

5. The device as defined in claim 4, wherein the first, second and third engagement regions are disposed along an inside edge of the second end of the hook member and opposite the inner surface of the flexible member.

6. The device as defined in claim 5, further comprising a plurality of additional engagement regions comprised of two faces disposed at an angle relative to each other and adapted to selectively receive the first edge of the one of the vanes of the vent diffuser therein; and wherein each of the additional engagement regions is disposed on the inside edge of the second end of the hook member.

7. The device as defined in claim 1, wherein the locking mechanism further comprises a connector member disposed on the inner surface of the flexible member, and wherein the connector member is fixedly secured to the inner surface of the flexible member in a fixed orientation relative to the inner surface; and the connector member is adapted to engage a different region of the one of the vanes from that engaged by the hook member.

8. The device as defined in claim 7, wherein the connector member comprises:

a tab fixedly secured to the inner surface of the flexible member and extending outwardly therefrom, said tab in combination with the inner surface of the flexible member being adapted to engage a second edge of the one of the vanes.

9. The device as defined in claim 8, wherein the tab includes a first section and a second section, wherein the first section is fixedly secured to the inner surface of the flexible member, is generally planar along its length, and is disposed at an angle relative to the inner surface of the flexible member; wherein the second section extends outwardly from an end of the first section; and wherein the second section is curved along its length and arches away from the inner surface of the flexible member.

10. The device as defined in claim 1, wherein the adjustment mechanism comprises:

a first guide and a second guide engaged with the inner surface of the flexible member, each of the first and second guides being oriented generally at right angles to the interior edge of the flexible member; wherein the channel is defined between the first and second guides; and when the first end of the hook member is in the first position the first end of the hook is closer to the interior edge of the flexible member than when the first end of the hook member is in the second position.

11. The device as defined in claim 1, wherein the adjustment mechanism further includes:

a stop extending outwardly from the inner surface of the flexible member and into the channel, and:

a slot is defined in the first end of the hook member and is sized to receive the stop of the adjustment mechanism therein; and wherein the stop is selectively engageable in the slot in any one of a plurality of different positions.

12. The device as defined in claim 11, wherein the stop is movable between an engaged position and a disengaged position, and when in the engaged position, the stop substantially prevents movement of the first end of the hook member along the length of the channel, and when in the disengaged position, the stop does not prevent movement of the first end of the hook member in the channel.

13. The device as defined in claim 11, further comprising:

an aperture defined in the flexible member and extending between the inner and outer surfaces thereof; and wherein the locking mechanism further includes:

a release button engaged with the hook member and extending through the aperture, and wherein a portion of the release button extends for a distance outwardly beyond the outer surface of the flexible member; and wherein the release button is selectively movable to an engaged position, and when in the engaged position, the release button is adapted to release the hook member from engagement with a vane of a diffuser to which the hook member is attached.

14. The device as defined in claim 1, where in the flexible member further includes an interior edge and an exterior edge opposed thereto, and side edges extending between the interior and exterior edges thereof; and wherein the device further comprises an extension member which is selectively engageable with one of the interior and exterior edges of the flexible member to increase the overall length of the flexible member and is subsequently removable therefrom to return the flexible member to its original length.

15. The device as defined in claim 14, wherein the extension member comprises:

a planar member having an upper surface, a lower surface, a first end, a second end and side edges extending therebetween, and a connector assembly provided adjacent one of the first and second ends for selectively engaging the planar member to one of the interior and exterior edges of the flexible member.

16. The device as defined in claim 15, wherein the one of the first and second ends which engages the one of the interior and exterior edges is of substantially the same length as the one of the interior and exterior edges and the other of the first and second ends is shorter than the one of the interior and exterior edges.

17. The device as defined in claim 15, wherein the connector assembly comprises:

a first flange extending outwardly from the outer surface of the extension member and parallel thereto, said first flange extending for a distance outwardly beyond the one of the first and second ends of the extension member;

a second flange extending outwardly from the inner surface of the extension member and parallel thereto, said second flange extending for a distance outwardly beyond the one of the first and second ends of the extension member; and a gap defined between the first and second flanges; and wherein the one of the interior and exterior edges of the flexible member is received within the gap and is retained therein.

18. The device as defined in claim 17, wherein the one of the interior and exterior edges of the flexible member includes a lip that projects beyond one or both of the inner and outer surfaces thereof, and the upper flange of the extension member defines a shoulder positioned to interlockingly engage the lip when the flexible member and extension member are engaged with each other.

19. A device for altering the airflow pattern from a ceiling vent diffuser having an interior surface and an exterior surface and where the airflow through the diffuser is from the interior surface and toward the exterior surface thereof, said device comprising:

a flexible member having an inner surface, an outer surface, an interior edge, an exterior edge and a pair of side edges extending between the interior and exterior edges;

a locking mechanism extending from the interior surface and being adapted to detachably engage the flexible member to the vent diffuser so as to obstruct a region of openings in the diffuser and thereby substantially prevent airflow from that obstructed region; and wherein the locking mechanism comprises:

a tab fixedly secured to the inner surface of the flexible member and extending outwardly therefrom, said tab in combination with the inner surface of the flexible member being adapted to engage a second edge of the one of the vanes;

a first hook member secured to the inner surface of the flexible member and extending outwardly therefrom, said first hook member having a first end and a second end and being resiliently biased to engage a second edge of one of the vanes; and an adjustment mechanism disposed on the inner surface of the flexible member; and wherein the first end of the first hook member is engaged with the adjustment mechanism and is movable therein between a first position and a second position; and, when the first end of the first hook member is in the first position, the second end of the first hook member is disposed in a first location set at a first distance relative to the inner surface of the flexible member; and when the first end of the first hook member is in the second position, the second end of the first hook member is disposed in a second location set at a second distance relative to the inner surface of the flexible member and wherein moving the hook member between the first and second positions results in the first end of the hook member moving along the inner surface of the flexible member.

20. The device as defined in claim 19, wherein the second end of the first hook member is curved relative to the first end thereof and in a direction extending toward the inner surface of the flexible member and wherein the first hook member is spring-biased toward the inner surface of the flexible member.

21. The device as defined in claim 20, further comprising at least one additional hook member that is selectively engageable with the adjustment mechanism when the first hook member is disengaged therefrom, and wherein the at least one additional hook member includes a second end that is differently configured to the second end of the first hook member.

* * * * *